US010925453B2

(12) United States Patent
Kwak et al.

(10) Patent No.: US 10,925,453 B2
(45) Date of Patent: Feb. 23, 2021

(54) VACUUM CLEANER AND CONTROL METHOD THEREOF

(71) Applicant: LG ELECTRONICS INC., Seoul (KR)

(72) Inventors: Donghoon Kwak, Seoul (KR); Jaehwan Ko, Seoul (KR); Hyukdo Kweon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 345 days.

(21) Appl. No.: 16/002,143

(22) Filed: Jun. 7, 2018

(65) Prior Publication Data

US 2018/0353035 A1 Dec. 13, 2018

(30) Foreign Application Priority Data

Jun. 8, 2017 (KR) ..... 10-2017-0071672
Sep. 15, 2017 (KR) ..... 10-2017-0118900
Sep. 15, 2017 (KR) ..... 10-2017-0118902

(51) Int. Cl.
*A47L 9/28* (2006.01)
*A47L 9/32* (2006.01)
*A47L 5/24* (2006.01)

(52) U.S. Cl.
CPC ..... *A47L 9/2852* (2013.01); *A47L 5/24* (2013.01); *A47L 9/2805* (2013.01); *A47L 9/2821* (2013.01); *A47L 9/2857* (2013.01); *A47L 9/2863* (2013.01); *A47L 9/325* (2013.01)

(58) Field of Classification Search
CPC ..... A47L 9/2852; A47L 9/2857; A47L 9/325; A47L 9/2805; A47L 9/2863; A47L 9/2821; A47L 5/24
IPC ..... A47L 9/28
See application file for complete search history.

(56) References Cited

U.S. PATENT DOCUMENTS 4,347,643 A * 9/1982 Bair, III ..... A47L 5/30 15/340.2
2018/0008112 A1* 1/2018 Ham ..... A47L 9/2894
2018/0192843 A1 7/2018 Kwak

FOREIGN PATENT DOCUMENTS

| | | |
|---|---|---|
| JP | H 05184505 | 7/1993 |
| JP | H 05228088 | 9/1993 |
| KR | 10-2006-0003188 | 1/2006 |
| KR | 100662625 | 1/2007 |
| KR | 10-2012-0139748 | 12/2012 |
| KR | 10-2016-0100154 | 8/2016 |
| KR | 10-2017-0008008 | 1/2017 |

OTHER PUBLICATIONS

KR Office Action dated Jan. 22, 2019 issued in KR Application No. 10-2017-0118900.
International Search Report dated Sep. 21, 2018 issued in Application No. PCT/KR2018/006467.

* cited by examiner

*Primary Examiner* — David Redding
(74) *Attorney, Agent, or Firm* — Ked & Associates, LLP

(57) ABSTRACT

The present disclosure relates to a cleaner according to one embodiment, which includes a main body, a grip unit provided on the main body to be gripped by a user, a pressure sensor unit provided on the grip unit to detect pressure applied by the user to a part of an outer surface of the grip unit, a driving unit provided at a lower portion of the main body to move the main body, and a controller to control the driving unit based on the detected pressure.

20 Claims, 28 Drawing Sheets

VACUUM CLEANER AND CONTROL METHOD THEREOF

CROSS-REFERENCE TO RELATED APPLICATIONS

This application claims priority under 35 U.S.C. § 119 to Korean Application Nos. 10-2017-0071672, filed on Jun. 8, 2017, 10-2017-0118902, filed on Sep. 15, 2017, and 10-2017-0118900, filed on Sep. 15, 2017, whose entire disclosures are hereby incorporated by reference.

BACKGROUND

1. Field

The present disclosure relates to a vacuum cleaner capable of moving a main body by assisting a user, and a method of controlling the same, and more particularly, a vacuum cleaner capable of moving a main body by facilitating a user's operation, a handle of the cleaner, and a method of controlling the cleaner.

2. Background

Generally, a vacuum cleaner is an apparatus that sucks dust, foreign substances and the like existing on a surface to be cleaned by using a suction motor provided inside a main body, and then filters the dust and foreign substances in the main body.

In recent years, a battery is mounted in the vacuum cleaner to supply power to the cleaner, such that a cleaning function can be executed even in a state where the cleaner is not connected to an external power source through a power line. In addition, the vacuum cleaner may include a driving unit that generates driving force by receiving power from the battery, and a controller of the vacuum cleaner may perform autonomous travel by controlling the driving unit according to a preset algorithm.

The vacuum cleaner may be classified into an upright type vacuum cleaner in which a suction nozzle is connected to a main body and moves together with the main body, and a canister type vacuum cleaner in which a suction nozzle is connected to a main body through an extension pipe, a handle, a hose, or the like.

Of the two types of vacuum cleaners, the upright type vacuum cleaner includes a cleaner main body in which a suction motor for generating suction force and the like are provided, a suction nozzle for sucking dust, foreign substances and the like, which are present on a surface to be cleaned, into the main body by the suction force generated in the suction motor, a handle provided on a top of the main body to be gripped by a user such that the suction nozzle moves along the surface to be cleaned, and the like.

That is, when power is applied to the main body and the suction motor is driven, suction force is generated, and air containing dust and foreign substances scattered on the surface to be cleaned is sucked into the suction nozzle by the suction force. The air containing the dust, the foreign substances, and the like flows into the main body, and the dust, the foreign substances, and the like are separated from the air into a dust collecting container mounted in the main body by a cyclone principle.

The separated dust, foreign substances, and the like are collected in the dust collecting container, and the separated air is discharged to outside of the main body through an air discharge portion.

Since such vacuum cleaner is moved only by the user's force, the user's fatigue is caused when friction against the surface to be cleaned or a load of the cleaner is great while the user cleans the surface with moving the cleaner. In particular, the upright type vacuum cleaner has a relatively heavy weight as compared with other types of vacuum cleaners, which causes user's inconvenience in using the upright type vacuum cleaner.

In order to solve such problem, the typical upright type vacuum cleaner may be provided with wheels which are rotated in response to physical force applied by the user. However, there is a problem that it is difficult to smoothly move the vacuum cleaner in a user-desired direction by merely employing the wheels which are passively rotated.

That is, in case of a vacuum cleaner having only passively-rotating wheels, when the user applies physical force to the vacuum cleaner in a specific direction, the wheels are rotated merely in response to the applied physical force, and any separate driving force for supplementing the user's physical force is not provided. Accordingly, when the user moves the upright type cleaner having only the passively-rotating wheels, the user cannot easily move the heavy main body of the cleaner.

BRIEF DESCRIPTION OF THE DRAWINGS

The embodiments will be described in detail with reference to the following drawings in which like reference numerals refer to like elements, and wherein.

DETAILED DESCRIPTION

Hereinafter, description will be given in detail of embodiments disclosed herein. Technical terms used in this specification are merely used for explaining specific embodiments and should not be constructed to limit the scope of the technology disclosed herein.

Figure 1:
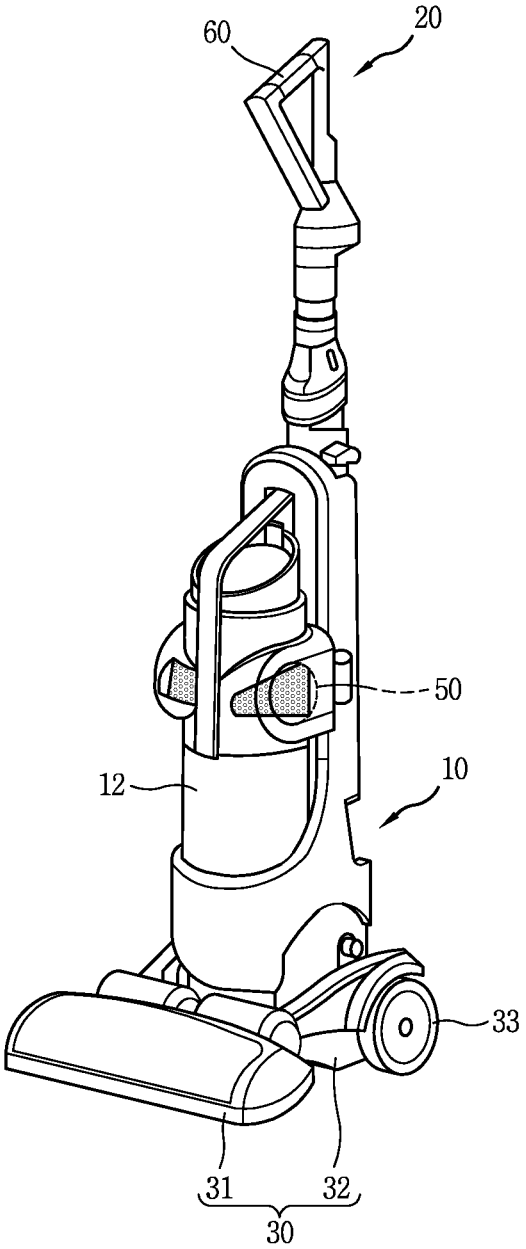
FIG. 1 is a conceptual view illustrating a cleaner to which the present disclosure is applicable.

Referring to FIG. 1, a cleaner according to the present disclosure includes a main body 10 having therein a dust collecting container 12, in which dust and foreign substances existing on a surface to be cleaned are collected, a suction nozzle 30 provided at a lower side of the main body 10 such that the main body 10 is mounted thereto, and configured to suck the dust and foreign substances scattered on the surface to be cleaned together with air, and a grip unit (or handle) 20 provided at an upper side of the main body 10 and gripped by the user to perform cleaning.

The main body 10 is rotatably coupled to an upper portion of the suction nozzle 30 such that an arrangement angle with respect to the surface to be cleaned can be varied, and the user may support the main body 10 such that the main body 10 is maintained in a state of being rotated toward the surface to be cleaned.

The dust collecting container 12 is detachably coupled to a front surface of the main body 10. The dust collecting container 12 is provided with a dust separating member 50 for separating dust and foreign substances contained in air sucked into the main body 10 by a cyclone principle.

That is, the air sucked into the main body 10 through the suction nozzle 30 flows into the dust collecting container 12, and the dust and foreign substances contained in the air introduced into the dust collecting container 12 are filtered by the dust separating member 50 and collected in the dust collecting container 12. The clean air from which the dust and foreign substances has been separated is discharged to outside of the main body 10.

Since the dust collecting container 12 is detachably coupled to the main body 10, the user can detach the dust collecting container 12 from the main body 10 to throw away the dust and foreign substances collected in the dust collecting container 12. Meanwhile, the dust collecting container 12 illustrated in FIG. 1 has a cylindrical shape but may alternatively be formed in a polygonal column shape such as a rectangular column, and the like.

The suction nozzle 30 includes a nozzle portion 31 for sucking dust and foreign substances scattered on the surface to be cleaned together with air, and a mounting portion 32 on which the main body 10 is mounted. When the user carries out cleaning, the nozzle portion 31 moves back and forth and to right and left relative to the surface to be cleaned in order to suck dust, foreign substances, and the like present on the surface to be cleaned.

A pair of wheels 33 are rotatably provided on both sides of the mounting portion 32 which is connected to the nozzle portion 31 and on which the main body 10 is mounted. That is, when the nozzle portion 31 moves relative to the surface to be cleaned, the mounting portion 32 connected to the nozzle portion 31 moves together. The wheels 33 smoothly rotate such that the suction nozzle 30 smoothly moves along the surface to be cleaned.

On the other hand, the grip unit 20 is provided at the upper side of the main body 10. Accordingly, during cleaning, the user can grasp (hold, grip) the grip unit 20 to support the main body 10 such that the main body 10 is maintained in a rotated state by a predetermined angle.

The grip unit 20 is provided with an input unit (or input device) 60 provided on a portion actually gripped by the user with a hand. The input unit 60 may enable the user to input a signal while settling his/her hand on the grip unit 20.

The input unit 60 is positioned within a range where the user grips the grip unit 20. Accordingly, the user can input a signal without moving a gripped position with respect to the grip unit 20 while the user grips the grip unit 20. That is, the grip unit 20 is a member that the user grips to move the cleaner, while the input unit 60 is a portion of the grip unit 20 with which the user's hand is actually brought into contact.

Therefore, the input unit 60 may be provided with a plurality of grooves corresponding to fingers so that the fingers can be brought into contact with the grooves when user holds the grip unit. This may facilitate the user to input a signal to the input unit 60. The user may move the cleaner by inputting a signal to the input unit 60 while settling the hand on the input unit 60.

Figure 2A:
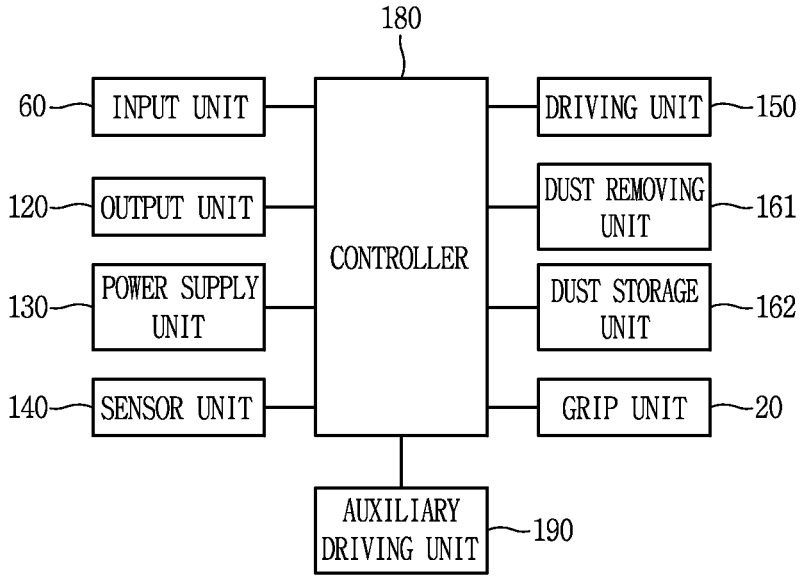
FIGS. 2A to 2C are block diagrams of a cleaner according to the present disclosure.

Referring to FIG. 2A, a block diagram illustrating components of the vacuum cleaner illustrated in FIG. 1 is shown. The vacuum cleaner may include at least one of an input unit (or input device) 60, an output unit (or display) 120 [or collectively referred to as a user input/output or user i/o], a power supply unit (or power supply) 130, a sensor unit (or sensor) 140, a driving unit (or suction motor) 150, a dust removing unit (or filter) 161, a dust storage unit (or dust bin) 162, a grip unit (or handle) 20, a controller 180, and an auxiliary driving unit (or auxiliary motor) 190.

The input unit 60 receives various control commands for the cleaner from the user. The input unit 60 may include one or more buttons. For example, the input unit 60 may include an adjustment button for adjusting an output of the cleaner, a power button for turning on and off the cleaner, a mode setting button for setting an operation mode of the cleaner, and the like.

Further, the input unit 60 may be installed on the grip unit 20 of the cleaner. In addition, the input unit 60 may be implemented as a hard key, a soft key, a touch pad, or the like. For example, the input unit 60 may implement a form of a touch screen together with the output unit 120.

Meanwhile, the output unit 120 may be installed on the cleaner main body or the grip unit 20. Of course, an installation location and an installation type may vary. For example, the output unit 120 may display information related to an output level, a battery status, an operation mode, and the like on a screen. The output unit 120 may be configured as one device of a light emitting diode (LED), a liquid crystal display (LCD), a plasma display panel, and an organic light emitting diode (OLED).

The output unit 120 may further include an audio output module for audibly outputting information related to an operation of the cleaner performed by the controller 180. For example, the output unit 120 may output warning sound to the outside in response to a warning signal generated by the controller 180. In this case, the audio output module may be means, such as a beeper, a speaker or the like for outputting sounds, and the output unit 120 may output sounds to the outside through the audio output module using audio data or message data having a predetermined pattern stored in a memory (not illustrated).

The power supply unit 130 may apply a DC voltage or an AC voltage to the vacuum cleaner. That is, the power supply unit 130 may include a first power supply module (not illustrated) that supplies AC power supplied from an external power supply device or a commercial power source directly into at least one component included in the cleaner. The first power supply module may include a rectifying circuit for converting AC power to DC power, a cord for transmitting AC power from a commercial power source, and a cord reel for winding the cord therearound.

In addition, the power supply unit 130 may include a second power supply module (not illustrated) that supplies DC power supplied from a battery to at least one component included in the cleaner. That is, the second power supply module may include a battery and a power terminal, and may apply power to the components of the vacuum cleaner using the DC power generated in the battery.

Meanwhile, the power supply unit 130 may store power supplied from an external power supply device in the battery and supply the stored power to at least one component included in the cleaner. At this time, the battery may receive power from the external power supply device through the power supply unit by a wired/wireless charging scheme. That is, the battery may receive power by being directly connected to the external power supply device by a component such as a power consent through the power supply unit 130 included in the cleaner, or by being connected to the external power supply device using a magnetic resonance coupling method, an electromagnetic induction method, and a radiowave method. The vacuum cleaner can receive power from the battery provided therein when it is not connected to an external power source.

Figure 2B:
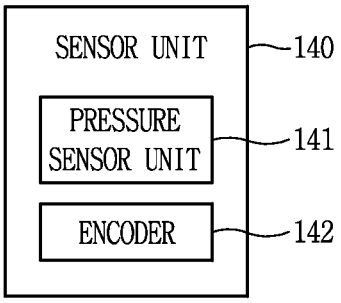

Referring to FIG. 2B, the sensor unit 140 may include a pressure sensor unit (or pressure sensor) 141 and an encoder 142. The pressure sensor unit 141 may be provided on an outer surface of the grip unit 20. That is, the pressure sensor unit 141 may protrude to the outer surface of the grip unit 20. When the user holds the grip unit 20, the pressure sensor unit 141 may be brought into contact with the user's hand.

That is, the pressure sensor unit 141 may be provided on the grip unit 20 so as to detect pressure that the user applies to a part of the outer surface of the grip unit. Although not illustrated in FIG. 2B, the sensor unit 140 may include at least one of an external signal sensor, a front sensor, a cliff sensor, a lower camera sensor, or an upper camera sensor. The external signal sensor may sense an external signal of a moving robot. The external signal sensor may be, for example, an infrared ray (IR) sensor, an ultrasonic sensor, a radio frequency (RF) sensor, or the like.

The driving unit (or driving motor) 150 provides suction force by a motor. Here, the motor may be a Brushless DC (BLDC) motor used in a general cleaner but is not limited thereto. The driving unit 150 may include a suction motor, and a suction fan rotated by the suction motor to generate the suction force.

The driving unit 150 may include a wheel (or driven wheel) for moving the main body 10, and a driving motor for transmitting driving force to the wheel. Hereinafter, a more detailed embodiment of the driving unit 150 according to the present disclosure will be described with reference to FIGS. 5A to 5C.

The dust removing unit 161 and the dust storage unit 162 may be installed inside or outside the main body 10 to facilitate coupling with and separation from the main body 10. For example, at least one of the dust removing unit 161 and the dust storage unit 162 may include a handle. The user may easily attach and detach at least one of the dust removing unit 161 and the dust storage unit 162 from the main body 10 by holding the handle.

Meanwhile, the dust storage unit 162 includes a case. That is, the dust storage unit 162 may include a container for storing dust. The case communicates with the dust removing unit 161 to store dust separated in the dust removing unit 161. That is, the case forms a space or region which is separate from the dust removing unit 161, and stores dust in the space.

The controller 180 controls the overall operation of the components included in the cleaner. The controller 180 may provide or process appropriate information or functions to the user by processing signals, data, information, etc. input or output through the above-mentioned components or by activating application programs stored in the memory (not illustrated).

Also, the controller 180 may control at least some of the components illustrated in FIG. 2A, to execute the application programs that have been stored in the memory. Further, the controller 180 may operate at least two of the components included in the cleaner in a combination manner for executing the application program.

The controller 180 may determine whether the user has gripped the grip unit 20 based on a temperature value sensed by a temperature sensor (not illustrated) or a pressure value sensed by the pressure sensor unit 141. Specifically, the controller 180 may determine that the user has gripped the grip unit 20 when a temperature sensed by the temperature sensor provided in the grip unit 20 is a reference temperature value or more. For example, the reference temperature value may be set to substantially correspond to a body temperature. In addition, the controller 180 may set the reference temperature differently according to a current date or time. In addition, the controller 180 may store a temperature value sensed by the temperature sensor at predetermined time intervals, and may set the reference temperature using the stored temperature values.

The controller 180 may determine that the user has gripped the grip unit 20 when the temperature sensed by the temperature sensor is within a reference temperature range. For example, when the sensed temperature exceeds an upper limit value of the reference temperature range, the controller 180 may determine that heat applied to the temperature sensor is due to an object other than the user, and stop the operation of the driving unit 150.

The controller 180 may also determine that the user has gripped the grip unit 20 when pressure sensed by the pressure sensor unit 141 included in the grip unit 20 is a reference pressure value or more. Specifically, the reference pressure value may be set by the user. The output unit 120 may output guide information to the user to set the reference pressure value at the beginning of the operation of the cleaner, and the controller 180 may set the reference pressure value based on pressure applied to the pressure sensor unit 141 after the guide information is output.

For example, the output unit 120 may output voice information "Please hold the handle" when the cleaner is initially driven or when the cleaner operates in a mode for resetting the reference pressure value. The controller 180 may set the reference pressure value by processing information related to pressure applied to the pressure sensor unit 141 at a plurality of time points during a preset time interval after the voice information is output. On the other hand, the guide information is not limited to the voice information and may alternatively be output in various forms.

The controller 180 may determine that the user has gripped the grip unit 20 when the sensed pressure is within the reference pressure range. On the other hand, when the sensed pressure exceeds the upper limit of the reference pressure range, the controller 180 may determine that the pressure applied to the pressure sensor unit 141 is due to an object other than the user, and stop the operation of the driving unit 150.

The controller 180 may operate the driving unit 150 when it is determined that the user has gripped the grip unit 20, and stop the driving unit 150 when it is determined that the user has not gripped the grip unit 20. That is, the controller 180 may control the driving unit 150 to generate suction force of the cleaner when it is determined using at least one of the temperature sensor and the pressure sensor unit 141 provided in the grip unit 20 that the user has gripped the grip unit 20.

In one embodiment, the controller 180 may control the driving unit 150 to adjust strength or magnitude of the suction force generated in the driving unit 150 according to strength of the sensed pressure. That is, the controller 180 may control the driving unit 150 to more increase an output of the cleaner as the user grips the grip unit 20 more strongly.

The controller 180 may be provided inside the main body 10 of the cleaner or inside the grip unit 20. The input unit 60, the output unit 120, the sensor unit 140 and the controller 180 of the cleaner according to one embodiment may be provided inside or outside the grip unit 20. The input unit 60, the output unit 120, the power supply unit 130, the sensor unit 140, the driving unit 150, and the controller 180 of the cleaner according to another embodiment of the present disclosure may be provided in the main body of the cleaner. The input unit 60, the output unit 120, the sensor unit 140, and the controller 180 of the cleaner according to another embodiment may be provided in the grip unit 20 and the cleaner main body, respectively.

Hereinafter, one embodiment of a cleaner handle 100 according to the present disclosure will be described with reference to FIG. 2C. For reference, the cleaner handle 100 is defined as a component corresponding to the grip unit 20. That is, the grip unit 20 and the cleaner handle 100 are defined as the same meaning.

Figure 2C:
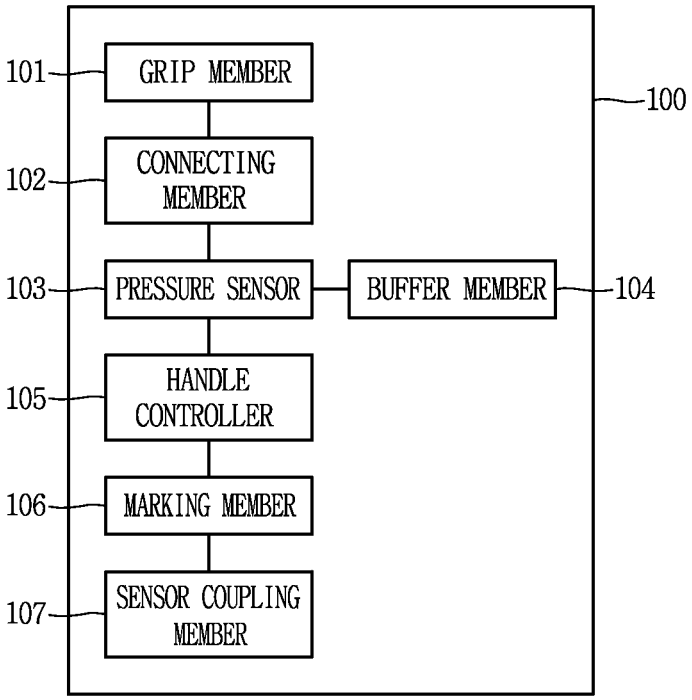

Referring to FIG. 2C, the cleaner handle 100 may include at least one of a grip member (or handle grip) 101, a connecting member (or connector) 102, a pressure sensor 103, a buffer member (or buffer) 104, and a handle controller 105. Specifically, the grip member 101 corresponds to a portion of the cleaner handle 100 that the user grips directly. The grip member 101 may be formed of a material that the user can easily grip. Also, although not illustrated in FIG. 2C, an anti-slip member (not illustrated) may be provided on an outer surface of the grip member 101 to prevent the user's hand from slipping.

For example, the anti-slip member may include a plurality of protrusions formed on the outer surface of the grip member 101. In another example, the anti-slip member may be formed of a material having a friction coefficient of a predetermined value or more upon being brought into contact with a skin of a human body.

The connecting member 102 may connect the grip member 101 with a part of the main body 10. The connecting member 102 may connect the grip member 101 and the main body 10 so that the grip member 101 can be rotated with respect to the main body 10.

For example, the connecting member 102 may include a fixed shaft coupled to the side of the main body 10, and a rotating shaft coupled to the side of the grip member 101. At this time, the rotating shaft and the grip member 101 may be formed integrally with each other.

In another example, a spider (not shown) may be provided between the fixed shaft and the rotating shaft of the connecting member 102. The spider may be connected to the fixed shaft and the rotating shaft, respectively, and the rotating shaft may be rotatable with respect to the fixed shaft within a predetermined range. In order to connect the fixed shaft and the rotating shaft to the spider, respectively, each of the fixed shaft and the rotating shaft may be provided with a plurality of holes.

In one embodiment, the pressure sensor 103 may be provided on at least one of a plurality of points on an outer surface of the fixed shaft, at which the grip member 102 is brought into contact with the fixed shaft of the connecting member 102 when the rotating shaft of the connecting member 102 rotates with respect to the main body 10. That is, the pressure sensor 103 may be provided on at least one of the plurality of points on the outer surface of the fixed shaft, at which the rotating shaft and the fixed shaft are brought into contact with each other, so as to detect pressure generated between the rotating shaft and the fixed shaft. The handle controller 105 or the controller 180 of the cleaner may thus detect information related to an advancing or traveling direction of the cleaner main body 10 by using the pressure detected by the pressure sensor 103.

The pressure sensor 103 may detect pressure applied to the cleaner handle 100. A plurality of pressure sensors 103 may be provided on the cleaner handle 100 and each pressure sensor may transmit information related to the detected pressure to the handle controller 105 or the controller 180 of the cleaner. Specifically, the pressure sensor 103 may detect pressure generated by physical force applied by the user to the cleaner handle 100. In addition, the pressure sensor 103 may detect pressure generated between components of the cleaner handle 100 due to a movement or rotation of the grip member 101. As described above, the pressure sensor 103 can be provided at a position, on which physical force is generated by the movement or rotation of the grip member 101, on the outer surface of the connecting member 102, so as to detect the pressure generated due to the movement or rotation of the grip member 101.

The buffer member 104 may be coupled to the pressure sensor 103. For example, the buffer member 104 may be a sponge or spring.

The handle controller 105 may detect a moving direction or rotating direction of the cleaner handle 100 by using information detected by the pressure sensor 103. In addition, the handle controller 105 may extract information related to a direction, in which the user intends to move the cleaner, by using the information detected by the pressure sensor 103.

For reference, the handle controller 105 may be provided in the cleaner handle 100 separately from the controller 180 of the cleaner. Further, the handle controller 105 may be substantially the same as the controller 180 of the cleaner.

That is, the cleaner handle 100 according to the present disclosure may include the handle controller 105, separate from the controller 180 of the cleaner. The handle controller 105 may detect information related to a direction, in which the user moves the cleaner, by using a detection value received from the pressure sensor 103.

In addition, the pressure sensor 103 of the cleaner handle according to the present disclosure may be connected to the controller 180 of the cleaner. In this case, the controller 180 may detect the information related to the direction, in which the user moves the cleaner, by using the detection value received from the pressure sensor 103.

As described above, the handle controller 105 may also exist separately from the controller 180 of the cleaner, but the following description will be given based on the controller 180 for convenience of explanation. Therefore, it is to be understood that the following configuration performed the controller 180 can be performed by the handle controller 105.

A marking member (or handle marking) 106 may provide information related to an arranged position of the pressure sensor 103. That is, when the arranged position of the pressure sensor 103 is not exposed to the user, the cleaner handle 100 may be provided with the marking member 106 for indicating the arranged position of the pressure sensor 103, to guide the position of the pressure sensor 103 to the user. For example, the marking member 106 may guide the user in a manner that the highest pressure is generated at the arranged position of the marking member 106 when external force is applied to the grip member 101.

Accordingly, the user can take into account the marking member when applying physical force to the grip member 101, which may allow the controller 180 to detect the user's intention more accurately. Therefore, the user of the cleaner according to the present disclosure can apply the physical force to the grip member 101 in consideration of the marking member 106, and accordingly the controller 180 can more accurately detect the moving direction or the rotating direction of the cleaner.

Figure 3A:
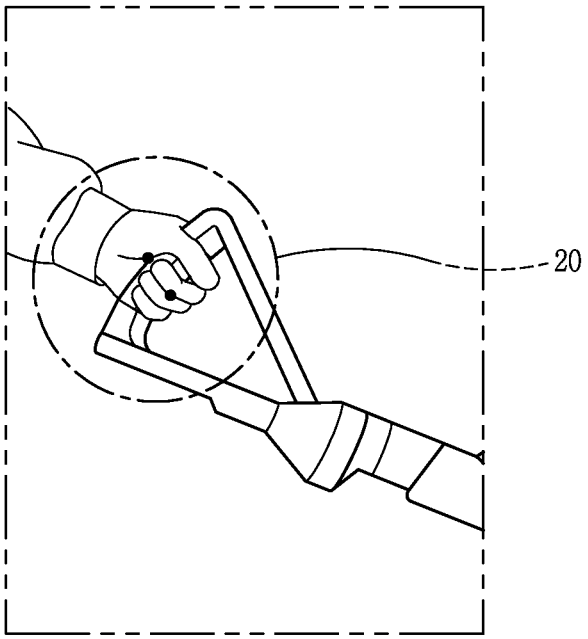
FIGS. 3A to 3E are conceptual views illustrating a grip unit of a cleaner according to the present disclosure.

Hereinafter, one embodiment of the grip unit 20 according to the present disclosure will be described with reference to FIGS. 3A to 3E. As illustrated in FIG. 3A, the grip unit 20 may be formed in a triangular shape. Particularly, when the main body 10 forms a predetermined angle with the ground, one side of the triangle formed by the grip unit 20 may be substantially parallel to the ground. The input unit 60 may be provided on the one side of the triangle.

A part of the grip unit 20 which is gripped by the user, as illustrated in FIG. 3A, may be provided with a pressure sensor unit 141. Particularly, considering the part, a portion facing the ground is defined as a rear surface and a portion facing a ceiling is defined as an upper surface.

Figure 3B:
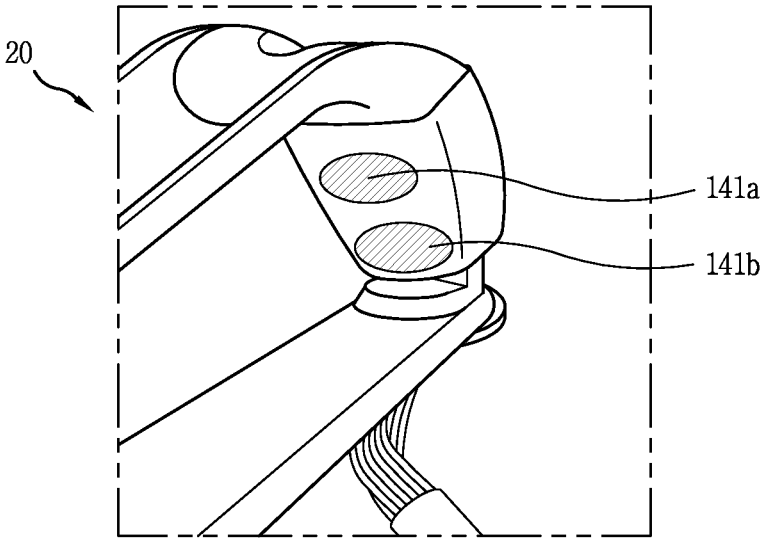

As illustrated in FIGS. 3B to 3E, the pressure sensor unit 141 may include a plurality of pressure sensors, and the plurality of pressure sensors may be installed on the portion of the grip unit 20 gripped by the user. Referring to FIG. 3B, the plurality of pressure sensors may be provided on the rear surface of the grip unit 20. Specifically, a first pressure sensor 141*a* and a second pressure sensor 141*b* may be provided on the rear surface of the grip unit 20.

Figure 3C:
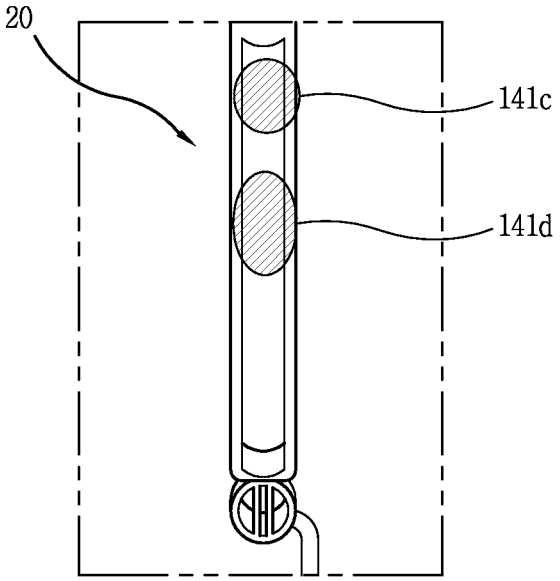
Figure 3D:
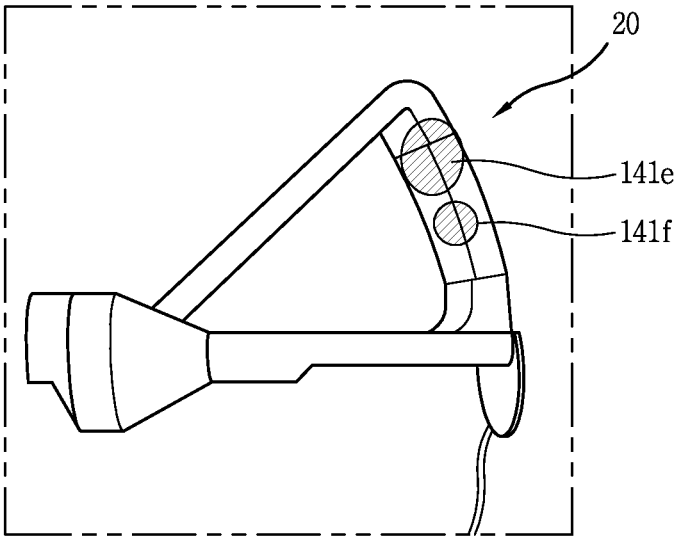

Referring to FIG. 3C, a third pressure sensor 141*c* and a fourth pressure sensor 141*d* may be provided on the upper surface of the grip unit 20. Referring to FIG. 3D, a fifth pressure sensor 141*e* and a sixth pressure sensor 141*f* may be provided on a left-side surface of the grip unit 20 with respect to the advancing direction of the main body.

Figure 3E:
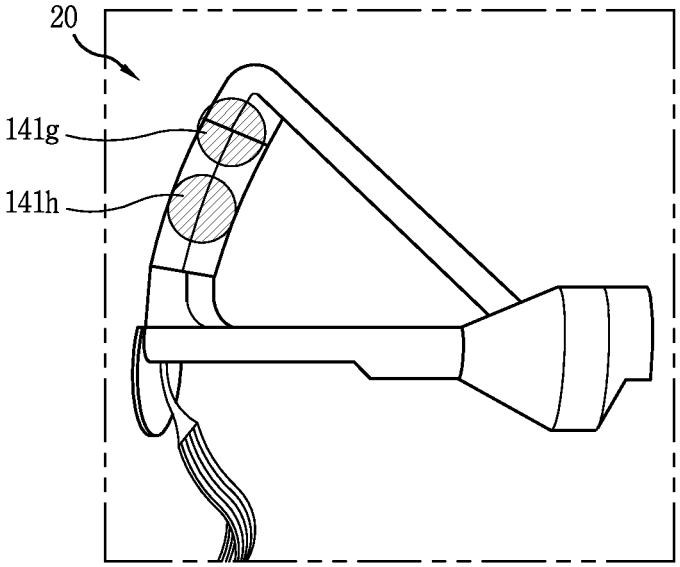

Referring to FIG. 3E, a seventh pressure sensor 141*g* and an eighth pressure sensor 141*h* may be provided on a right-side surface of the grip unit 20 with respect to the advancing direction of the main body. The controller 180 of the vacuum cleaner according to the present disclosure may control the driving unit 150 based on information related to pressure detected by the pressure sensor unit 141.

As illustrated in FIGS. 3A to 3E, the pressure sensor unit 141 may include a plurality of pressure sensors 141*a*, 141*b*, 141*c*, and 141*d*, 141*e*, 141*f*, 141*g*, and 141*h* which detect pressure applied to different points of the outer surface of the grip unit 20, respectively.

Specifically, the controller 180 may compare an output of any one of the plurality of pressure sensors 141*a*-141*h* with an output of another pressure sensor 141*a*-141*h* provided behind the one pressure sensor based on the traveling direction of the cleaner. In this case, the controller 180 may determine whether the cleaner is moving forward or backward based on the comparison result. That is, the controller 180 may determine that the cleaner is moving forward when an output of a pressure sensor installed relatively ahead is greater than an output of a pressure sensor installed relatively behind.

When it is determined that the cleaner is moving forward, the controller 180 may control the driving unit 150 to generate a driving force in a forward direction of the cleaner. On the other hand, the controller 180 may determine that the cleaner is moving backward when an output of a pressure sensor installed relatively behind is greater than an output of a pressure sensor installed relatively ahead.

When it is determined that the cleaner is moving backward, the controller 180 may control the driving unit 150 to generate a driving force in a backward direction of the cleaner. For example, the controller 180 may compare the outputs of the first pressure sensor and the second pressure sensor with the outputs of the third pressure sensor and the fourth pressure sensor, and determine whether or not the user applies an external force to the grip unit 20 to move the cleaner forward based on the comparison result.

In detail, the controller 180 may determine that the user has applied the external force to the grip unit 20 to move the cleaner forward when an average output value of the first pressure sensor and the second pressure sensor is smaller than an average output value of the third pressure sensor and the fourth pressure sensor.

In another example, the controller 180 may compare the output of any one of the first pressure sensor and the second pressure sensor with the output of any one of the third pressure sensor and the fourth pressure sensor, and determine that the user has applied the external force to the grip unit 20 to move the cleaner forward based on the comparison result.

In another example, the controller 180 may calculate a difference between the average output value of the first pressure sensor and the second pressure sensor and the average output value of the third pressure sensor and the fourth pressure sensor, and detect a change in the calculated difference. The controller 180 may then determine based on the detected change whether or not the user applies the external force to the grip unit 20 to move the cleaner forward.

In another example, the controller 180 may also determine whether or not the user applies the external force to the grip unit 20 to move the cleaner forward based on the output values of the third pressure sensor and the fourth pressure sensor. That is, the controller 180 may compare an output of one pressure sensor, which is installed relatively ahead, of two pressure sensors installed on one surface of the grip unit 20, with an output of another pressure sensor which is installed relatively behind, and detect a direction that the user desires to move the cleaner based on the comparison result.

The controller 180 may compare the output values of the plurality of pressure sensors and determine whether the cleaner rotates clockwise or counterclockwise based on the comparison result. Specifically, the controller 180 may compare the outputs of the two pressure sensors provided on the left-side surface of the grip unit 20 with respect to the traveling direction of the cleaner, and determine whether the cleaner rotates clockwise or counterclockwise based on the comparison result.

That is, the controller 180 may determine that the user desires to rotate the cleaner in the counterclockwise direction when the output of one pressure sensor, which is provided relatively below, of the two pressure sensors provided on the left-side surface, is greater than the output of another pressure sensor provided relatively above. For example, the controller 180 may determine that the cleaner rotates in the counterclockwise direction when the output of the fifth pressure sensor 141*e* is smaller than the output of the sixth pressure sensor 141*f*. Also, the controller 180 may determine that the user applies the external force to the grip unit 20 in order to rotate the cleaner in the counterclockwise direction when the output of the fifth pressure sensor unit 141*e* is smaller than the output of the sixth pressure sensor 141*f*.

Similarly, the controller 180 may compare the outputs of the two pressure sensors provided on the right-side surface of the grip unit 20 with respect to the traveling direction of the cleaner, and determine whether the cleaner rotates clockwise or counterclockwise based on the comparison result. That is, the controller 180 may determine that the user desires to rotate the cleaner in the clockwise direction when the output of one pressure sensor, which is provided relatively below, of the two pressure sensors provided on the right-side surface, is greater than the output of another pressure sensor provided relatively above.

For example, the controller 180 may determine that the cleaner rotates in the clockwise direction when the output of the seventh pressure sensor 141*g* is smaller than the output of the eighth pressure sensor 141*h*. Also, the controller 180 may determine that the user applies the external force to the grip unit 20 in order to rotate the cleaner in the clockwise direction when the output of the seventh pressure sensor unit 141*g* is smaller than the output of the eighth pressure sensor 141*h*.

In addition, the controller 180 may control the driving unit 150 to reduce the output of the pressure sensor unit 141. Specifically, when a traveling direction of the cleaner or a direction that the user wants to move the cleaner is determined, the controller 180 may control the driving unit 150 to generate driving force in the determined traveling direction or increase an existing driving force to assist the travel of the cleaner.

In one example, the controller 180 may periodically monitor the output of the pressure sensor unit 141. When the output of the pressure sensor unit 141 increases during the monitoring, the controller 180 may control the driving unit 150 to stop the wheels or change the rotating direction of the wheels.

In one embodiment, the controller 180 may determine that the user has gripped the grip unit 20 when the pressure detected by the pressure sensor unit 141 is a reference pressure value or more. In another embodiment, the controller 180 may determine that the user has gripped the grip unit 20 when the detected pressure is within a reference pressure range.

On the other hand, when the detected pressure exceeds an upper limit of the reference pressure range, the controller 180 may determine that the pressure applied to the pressure sensor unit 141 is generated due to another object other than the user. The controller 180 may operate the driving unit 150 when it is determined that the user has gripped the grip unit 20 and stop the driving unit 150 when it is determined that the user has not gripped the grip unit 20.

Figure 4:
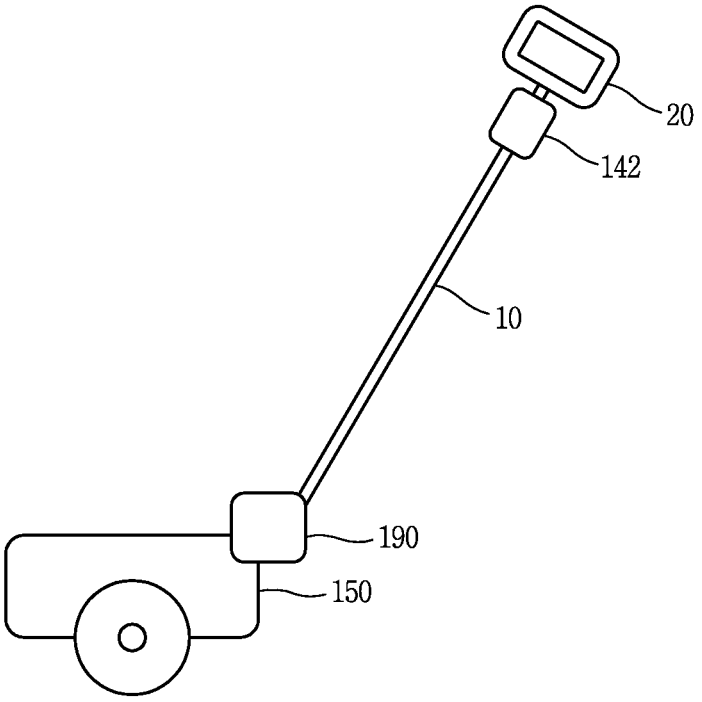
FIG. 4 is a conceptual view of a cleaner according to the present disclosure.

Referring to FIG. 4, the grip unit 20 is provided on the main body 10 to be gripped by the user. The driving unit 150 may be provided at a lower portion of the main body 10 to move the main body 10.

Further, an encoder 142 may be provided between the grip unit 20 and the main body 10. Further, an auxiliary driving unit 190 may be provided between the main body 10 and the driving unit. Specifically, the encoder [or angle sensor] 142 may detect information related to a rotation angle between the main body 10 and the grip unit 20. Further, the encoder 142 may detect information related to a rotating speed of the grip unit 20 with respect to the main body 10.

Although not illustrated in detail in FIG. 4, the grip unit 20 may be rotatably connected to the main body 10. In this case, the encoder 142 may detect an angle of the grip unit 20 rotated from a predetermined reference axis. The predetermined reference axis may correspond to the advancing direction of the cleaner.

The auxiliary driving unit 190 may provide an auxiliary driving force to the main body 10 in the rotating direction of the main body 10 when the main body 10 rotates in a predetermined direction. The auxiliary driving unit 190 may receive an operation signal from the controller 180 and operate based on the applied operation signal. That is, the controller 180 may detect a direction in which the user desires to rotate the main body 10 and control the auxiliary driving unit 190 to generate an auxiliary driving force in the detected direction.

In one embodiment, the auxiliary driving unit 190 may be configured as a timing belt coupled to a motor, such as the suction motor for the driving unit 150. In another embodiment, the auxiliary driving unit 190 may be configured as a speed reducer coupled to a motor.

Figure 5A:
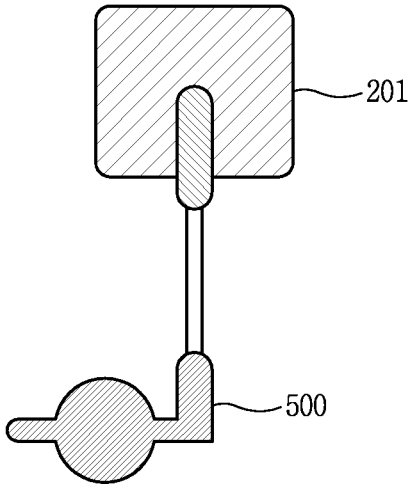
FIGS. 5A to 5C are conceptual views illustrating various embodiments related to a driving unit of a cleaner according to the present disclosure.

Hereinafter, various embodiments of the driving unit 150 will be described with reference to FIGS. 5A to 5C. As illustrated in FIG. 5A, according to one embodiment of the present disclosure, the driving unit 150 may include a single wheel coupled to a driving unit housing 201. In this case, the controller 180 in a main body housing 500 may determine a rotating direction of the wheel to make the main body 10 move forward or backward.

Figure 5B:
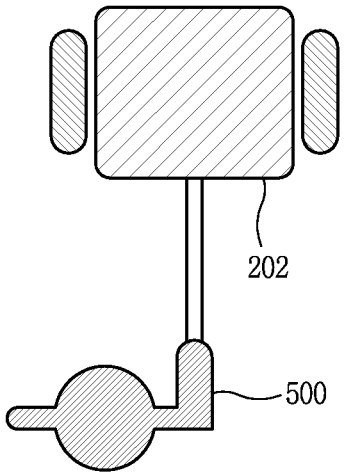

In addition, according to another embodiment of the present disclosure illustrated in FIG. 5B, the driving unit 150 may include two wheels around a driving unit housing 202. The two wheels may receive driving force from separate motors or from the same motor. In this case, the controller 180 may control the driving unit 150 such that the main body moves forward or backward or rotates.

Figure 5C:
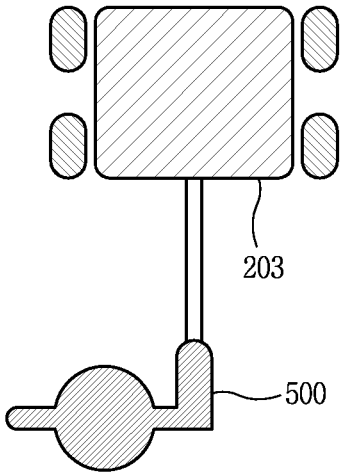

In addition, according to another embodiment of the present disclosure illustrated in FIG. 5C, the driving unit 150 may include four wheels around a driving unit housing 203. The four wheels may receive driving forces from separate motors or from the same motor. In this case, the controller 180 may control the driving unit 150 such that the main body moves forward or backward or rotates.

Figure 6:
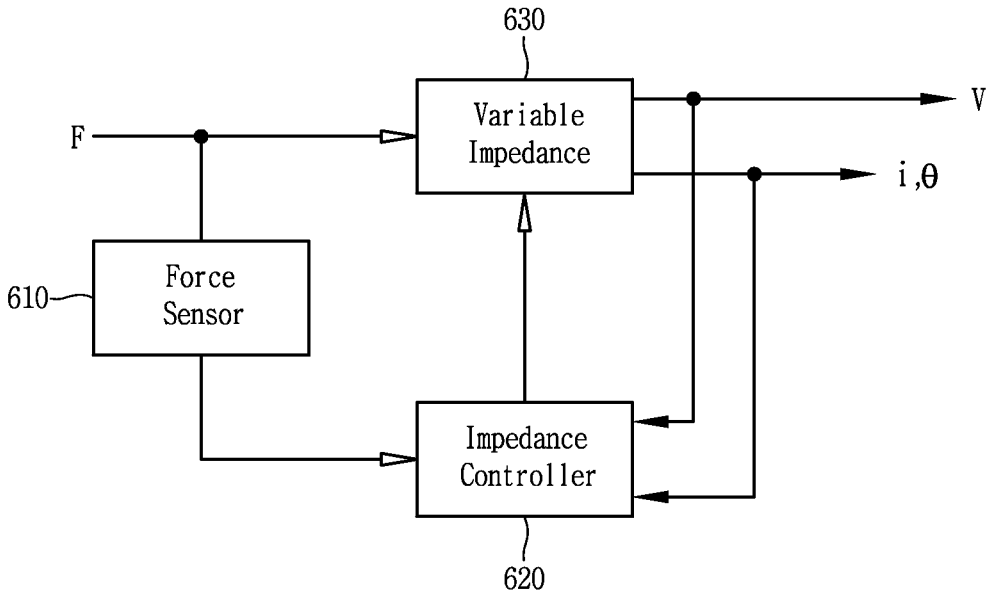
FIG. 6 is a block diagram of a cleaner according to the present disclosure.

Hereinafter, an impedance control method performed by the controller 180 according to the present disclosure will be described with reference to FIG. 6. As described above, the controller 180 may control the driving unit 150 to lower the output of the pressure sensor unit 141. In detail, the controller 180 may include an impedance controller 620 and the impedance controller 620 may reduce a variable impedance 630 of the cleaner. At this time, the impedance controller 620 may control a value of the variable impedance 630 using an output value of a force sensor 610.

Figure 7:
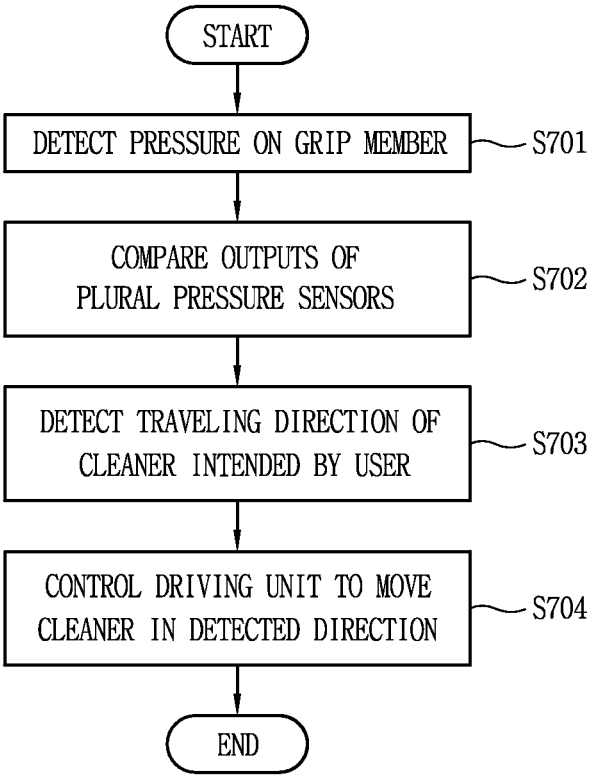
FIG. 7 is a flowchart illustrating a method of controlling a cleaner according to the present disclosure.

Hereinafter, a control method of the vacuum cleaner according to the present disclosure will be described with reference to FIG. 7. First, the pressure sensor unit 141 may detect pressure applied to the grip unit 20 (S701).

Specifically, a plurality of pressure sensors included in the pressure sensor unit 141 may detect pressure applied to a plurality of points on the outer surface of the grip unit 20, respectively. Further, the controller 180 may compare outputs of the plurality of pressure sensors (S702).

The controller 180 may detect a traveling direction of the cleaner intended by the user or a currently traveling direction of the cleaner by comparing the outputs of the plurality of pressure sensors (S703). In addition, the controller 180 may control the driving unit 150 to move the cleaner in the detected direction (S704).

Hereinafter, embodiments of the present disclosure relating to the grip unit 20, i.e., the cleaner handle 100, will be described with reference to FIGS. 8A and 8B. First, in description of the present disclosure, a first direction (Forward) which is a forward direction, a second direction (Backward) which is a backward direction, a third direction (Left) which is a left direction, and a right direction (Right) which is a right direction are defined with respect to the front of the main body 10. The definitions of the first to fourth directions are for convenience of explanation, and information related to the directions may be changed according to the user's setting.

Figure 8A:
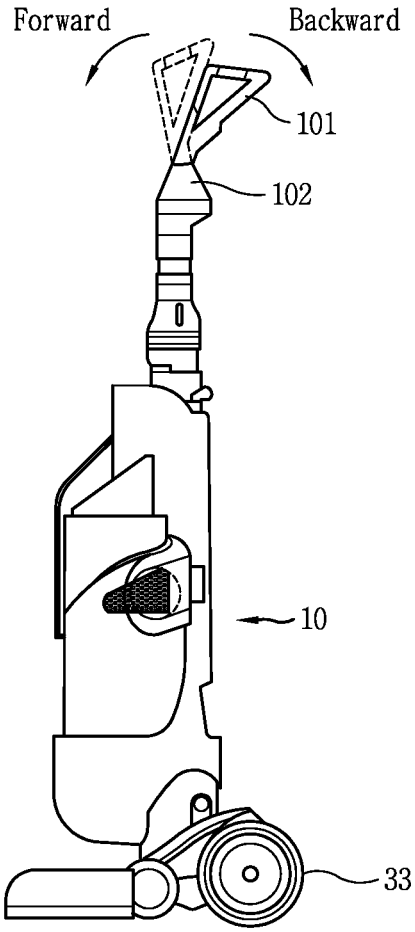
FIGS. 8A to 8C are conceptual views of a cleaner handle according to the present disclosure.

As illustrated in FIG. 8A, the cleaner handle 100 may be rotatable in the first direction (Forward) or the second direction (Backward) with respect to the main body 10. Specifically, the connecting member 102 may connect the grip member 101 with the main body 10 so that the grip member 101 is rotatable in the first direction or the second direction.

The connecting member 102 may connect the grip member 101 with the main body 10 so that the grip member 101 can rotate to a first limit position in the first direction and a second limit position in the second direction. At this time, the first and second limit positions may be changed according to the structure of the connecting member 102.

Figure 8B:
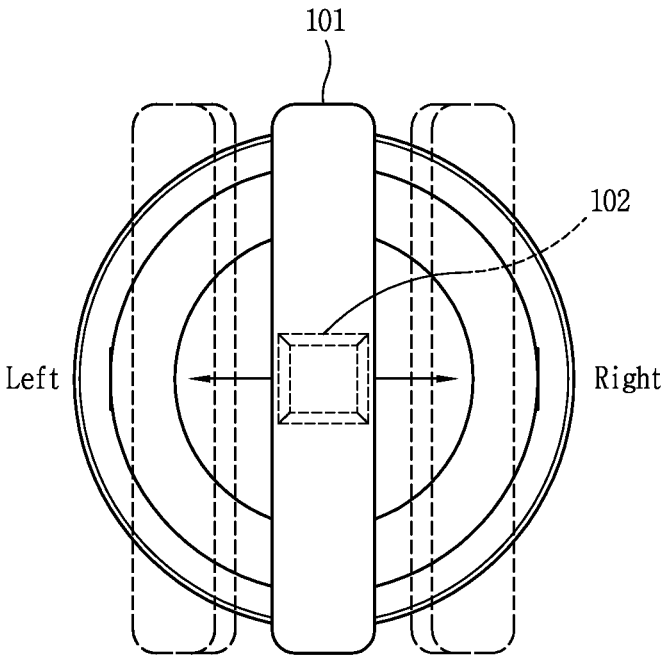

As illustrated in FIG. 8B, the cleaner handle 100 may be rotatable with respect to the main body 10 in the third direction (Left) or the fourth direction (Right). Similarly, the connecting member 102 may connect the grip member 101 with the main body 10 so that the grip member 101 can be rotated in the third direction or the fourth direction.

The connecting member 102 may connect the grip member 101 with the main body 10 so that the grip member 101 can rotate to a third limit position in the third direction and a fourth limit position in the fourth direction. At this time, the third and fourth limit positions may be changed according to the structure of the connecting member 102.

In addition, the connecting member 102 may connect the grip member 101 with the main body 10 so that the grip member 101 rotates by a first angle in one of the first direction and the second direction, and rotates by a second angle in one of the third direction and the fourth direction.

Figure 8C:
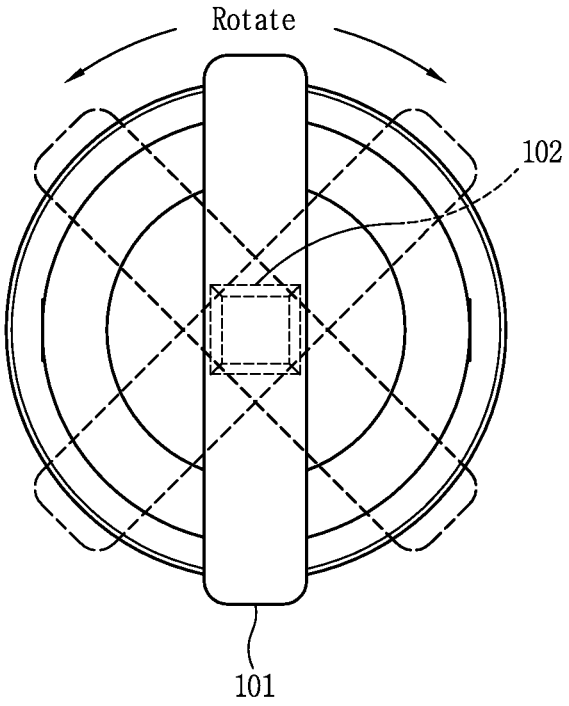

That is, as illustrated in FIGS. 8A and 8B, the grip member 101 may rotate forward or backward or to the right or left, based on an initial connection position. As described above, in order for the grip member 101 to rotate with respect to the main body 10, the connecting member 102 may be configured as a universal joint. For example, the universal joint can be of various types such as a cylindrical type, a cross type, a multi-cross type, and the like. On the other hand, referring to FIG. 8C, the cleaner handle 100 may rotate in place with respect to the main body 10 to the left or right based on a normal direction of the ground.

In one embodiment, the rotating shaft of the connecting member 102 may be formed to be rotatable to the left or right with respect to the fixed shaft based on the normal direction of the ground. In this case, at least one bearing (not illustrated) for rotating the rotating shaft may be provided between the rotating shaft and the fixed shaft.

In another embodiment, one end of the connecting member 102 at the side of the main body 10 may be formed so that the cleaner handle 100 is rotatable with respect to the main body 10 to the left or right based on the normal direction of the ground. In this case, the one end of the connecting member 102 at the side of the main body 10 may be formed in a conical shape or a spherical shape, and one end of the main body 10 at the side of the connecting member 102 may be formed in a shape corresponding to that of the one end of the connecting member 102. At least one bearing for rotating the connecting member 102 may be provided between the one end of the connecting member 102 at the side of the main body 10 and the one end of the main body 10 at the side of the connecting member 102.

Figure 9A:
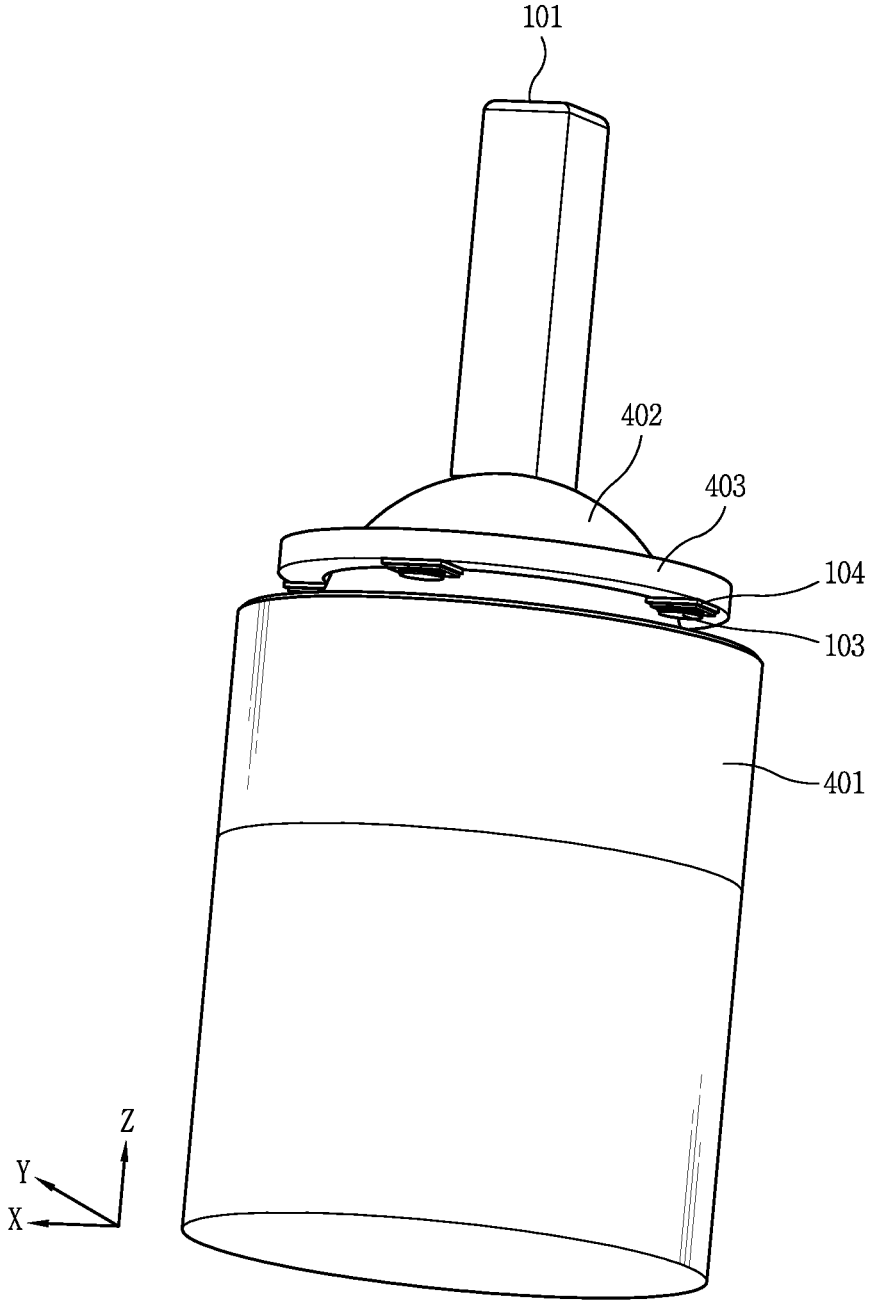
FIGS. 9A to 9C are conceptual views of a cleaner handle according to the present disclosure.

Hereinafter, the cleaner handle 100 according to one embodiment of the present disclosure will be described with reference to FIGS. 9A to 9C. Referring to FIG. 9A, the connecting member 102 may be configured as a ball type joint member.

As illustrated in FIG. 9A, the connecting member 102 may include a fixed shaft connected to the main body 10, and a rotating shaft rotatable relative to the fixed shaft.

Specifically, as illustrated in an embodiment of FIG. 9A, when the connecting member 102 is the ball type joint member, the connecting member 102 may include a ball head 402, a ball receiving portion (or socket) 401 for receiving the ball head, and a ring 403 formed on an outer circumferential surface of the ball head.

Specifically, the ball head 402 may be provided on the rotating shaft of the connecting member 102. Also, the ball receiving portion 401 may be provided in the fixed shaft of the connecting member 102. For example, the ball head 402 may be formed in a spherical shape, and the rotating shaft provided with the ball head 402 may be connected to the grip member 101.

For reference, the grip member 101 illustrated in FIG. 9A is formed into a rod shape, but this is merely illustrative. The shape of the grip member 101 according to the present disclosure is not limited thereto.

In another example, the ball receiving portion 401 may be formed in a cylindrical shape, and at least one bearing (not shown) may be provided between the ball receiving portion 401 and the ball head 402. By the bearing, the ball head 402 can rotate centering on an Y axis of the ball receiving portion 401. An inner circumferential surface of the ball receiving portion 401 may form a circle larger than a maximum circle formed by a cross section of the ball head 402.

On the other hand, the ring 403 may be formed to limit a turning radius of the rotating shaft or the ball head 402. That is, the ring 403 formed on the outer circumferential surface of the ball head may be formed to be in contact with the ball receiving portion 401 when the ball head 402 rotates from an initial position by a predetermined angle. Accordingly, the ring 403 can limit the turning radius to prevent the ball head from rotating by more than the predetermined angle.

Referring to FIG. 9A, at least one pressure sensor 103 may be provided on one surface of the ring 403. Specifically, the pressure sensor 103 may be provided on at least one of a plurality of points on an outer surface of the ring 403, which is brought into contact with the ball receiving portion 401 when the rotating shaft or the ball head 402 rotates relative to the main body 10.

Preferably, a first pressure sensor may be provided on one point on the outer surface of the ring 403 brought into contact with the ball receiving portion 401 when the rotating shaft or the ball head 402 connected to the grip member 101 rotates in the first direction (Forward) by the predetermined angle, a second pressure sensor may be provided on one point on the outer surface of the ring 403 brought into contact with the ball receiving portion 401 when the rotating shaft or the ball head 402 rotates in the second direction (Backward) by the predetermined angle, a third pressure sensor may be provided on one point on the outer surface of the ring 403 brought into contact with the ball receiving portion 401 when the rotating shaft or the ball head 402 rotates in the third direction (Left) by the predetermined angle, and a fourth pressure sensor may be provided on one point on the outer surface of the ring 403 brought into contact with the ball receiving portion 401 when the rotating shaft or the ball head 402 rotates in the fourth direction (Right) by the predetermined angle.

FIG. 9A illustrates one embodiment in which four pressure sensors are provided on one surface of the ring 403 facing the ball receiving portion 401 to correspond to the first to fourth directions, but the present disclosure is not limited thereto. That is, pressure sensors may be provided at points corresponding to more directions than the first to fourth directions on one surface of the ring 403 facing the ball receiving portion 401. The pressure sensor may detect pressure generated by an external force applied by the user when the ball head 402 rotates by a predetermined angle in a direction corresponding to each installed point.

Referring to FIG. 9A, a buffer member (or cushion) 104 may be provided between the pressure sensor 103 and the ring 403. The buffer member 104 may be formed of a material having elasticity and can prevent failure of the pressure sensor 103 or damage of the ring 403.

Figure 9B:
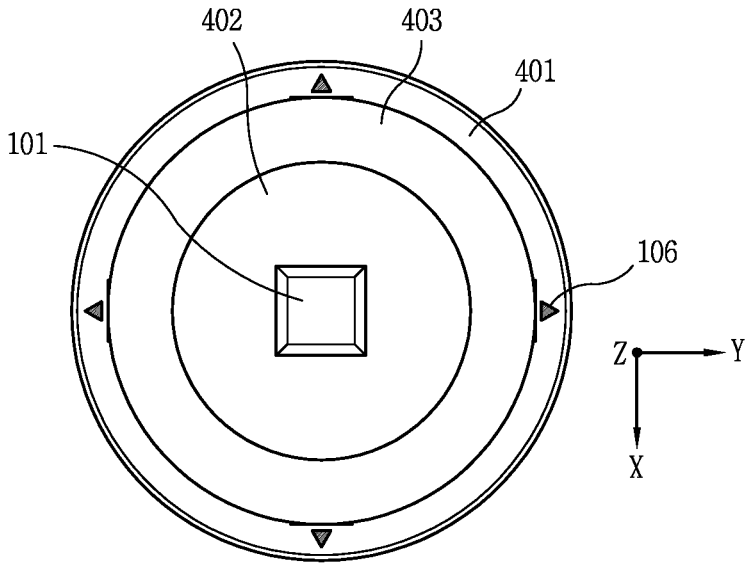

Referring to FIG. 9B, a planar view of the cleaner handle 100 according to an embodiment of the present disclosure is shown. Referring to FIG. 9B, the ball receiving portion 401 may be formed in a cylindrical shape. Therefore, one end surface of the ball receiving portion 401 may be in the form of a ring.

A radius of a circle formed by an inner circumferential surface of the ball receiving portion 401 may be smaller than a radius of a circle formed by an outer circumferential surface of the ring 403. Thus, when the ring 403 rotates by a predetermined angle without being inserted into the ball receiving portion 401, a part of the ring 403 may come into contact with the ring-shaped one end surface of the ball receiving portion 401.

Referring to FIG. 9B, the marking member 106 may be provided on the one end surface of the ball receiving portion 401 facing the grip member 101. That is, the marking member 106 may be provided on one surface of the ball receiving portion 401, which is opposite to (i.e., faces) the surface having the pressure sensor 103 on the outer surface of the ring 403.

As illustrated in FIG. 9A, since the pressure sensor 103 is provided on the one surface of the ring 403 facing the ring receiving portion 401, it may be difficult for the user to confirm the arranged position of the pressure sensor 103. Therefore, the installation position of the pressure sensor 103 can be guided by attaching the marking member 106 on the one end surface, which is highly visible to the user, of the ball receiving portion 401 facing the grip member 101.

On the other hand, the arranged position of the marking member 106 may be one surface of the ring 403 which is adjacent to the grip member 101 or the outer circumferential surface of the ball receiving portion 101. That is, the marking member 106 may be arranged at any position if the position is easily exposed to the user, and is not limited to the installation position. In addition, the marking member 106 may be formed on one surface of the ball receiving portion 101 or on one surface of the ring 403 in an engraving or embossing manner, instead of being provided as a separate member.

Figure 9C:
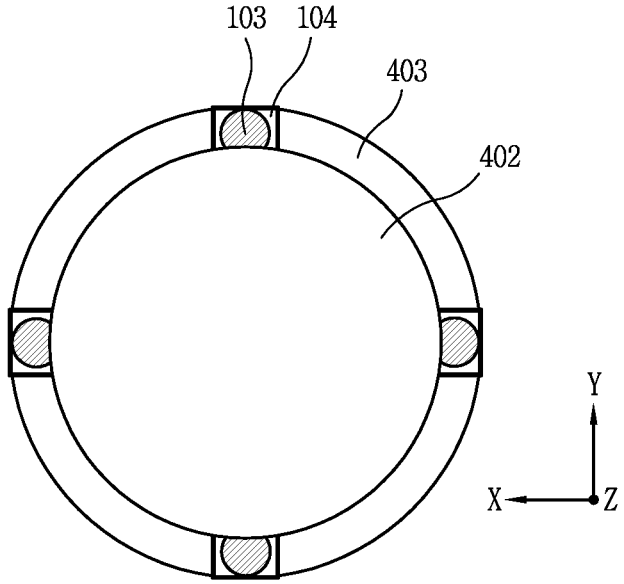

Referring to FIG. 9C, a bottom view of the ball head 402 and the ring 403 is shown. As illustrated in FIG. 9C, at least one pressure sensor 103 may be provided on one surface of the ring 403 facing the ball receiving portion 401. Also, the buffer member 104 may be provided between the pressure sensor 103 and the ring 403.

On the other hand, although not illustrated in FIG. 9C, the pressure sensor 103 may alternatively be provided on one end surface of the ball receiving portion 401 facing the ring. That is, the pressure sensor 103 may be arranged at a portion where the ring 403 provided on the ball head 402 and the ball receiving portion 401 are brought into contact with each other in a state where the ball head 402 rotates by a predetermined angle or more and cannot rotate any more.

According to one embodiment illustrated in FIGS. 9A to 9C, the pressure sensor 103 may include a first pressure sensor provided on a part of the outer surface of the ring 403 where the ball receiving portion 401 and the ring 403 are brought into contact with each other when the rotating shaft connected to the grip member 101 or the ball head 402 rotates in the forward direction of the main body 10, and a second pressure sensor provided on a part of the outer surface of the ring 4043 where the ball receiving portion 401 and the ring 403 are brought into contact with each other when the rotating shaft or the ball head 402 rotates in the backward direction of the main body 10.

The pressure sensor 103 may also include a third pressure sensor provided on a part of the outer surface of the ring 403 where the ball receiving portion 401 and the ring 403 are brought into contact with each other when the rotating shaft connected to the grip member 101 or the ball head 402 rotates in the left direction of the main body 10, and a fourth pressure sensor provided on a part of the outer surface of the ring 403 where the ball receiving portion 401 and the ring 403 are brought into contact with each other when the rotating shaft or the ball head 402 rotates in the right direction of the main body 10. In this case, the handle controller 105 or the controller 180 of the cleaner may determine the moving direction of the main body 10 by using at least one of the first to fourth pressure sensors.

In addition, the controller 180 may control the driving unit 150 to provide an auxiliary driving force in the determined direction. That is, when it is determined that the user is moving the cleaner forward, the controller 180 may control the driving unit 150 to provide the auxiliary driving force in the forward direction. In addition, when it is determined that the cleaner body is moving backward, the controller 180 may control the driving unit 150 to provide the auxiliary driving force in the backward direction.

Specifically, when a traveling direction of the cleaner or a direction that the user wants to move the cleaner is determined, the controller 180 may control the driving unit 150 to generate a driving force in the determined traveling direction or increase an existing driving force in order to assist the travel of the cleaner.

In one embodiment, the controller 180 may compare the outputs of the first to fourth pressure sensors, and determine a direction, which corresponds to a pressure sensor having the largest output among the first to fourth pressure sensors, as the traveling direction of the cleaner or the direction that the user desires to move the cleaner.

In another embodiment, the controller 180 may determine the traveling direction of the cleaner or the direction that the user desires to move the cleaner using the outputs of the first to fourth pressure sensors and vectors corresponding to the first to fourth pressure sensors. For example, the controller 180 may multiply the output values of the first to fourth pressure sensors by unit vectors of the first to fourth pressure sensors, respectively, and add the calculation results, thereby determining the traveling direction of the cleaner or the direction that the user desires to move the cleaner. On the other hand, the controller 180 may replace any of the output values of the first to fourth pressure sensors, which is a preset reference output value or less, with zero (0).

In another embodiment, the controller 180 may set magnitude of an auxiliary driving force based on magnitudes of the output values of the first to fourth pressure sensors. That is, when the output value of the first pressure sensor exceeds a reference value, the controller 180 may determine the traveling direction of the cleaner or the direction that the user desires to move the cleaner as a first direction, and control the driving unit 150 to supply the auxiliary driving force to the determined direction. At this time, the controller 180 may determine the output of the driving unit 150 according to the magnitude of the output value of the first pressure sensor.

Hereinafter, the cleaner handle 100 according to another embodiment of the present disclosure will be described with reference to FIGS. 10A and 10B. Compared to the embodiment illustrated in FIGS. 9A to 9C, the embodiment illustrated in FIGS. 10A and 10B shows that the connecting member 102 is formed as a single cross joint.

Figure 10A:
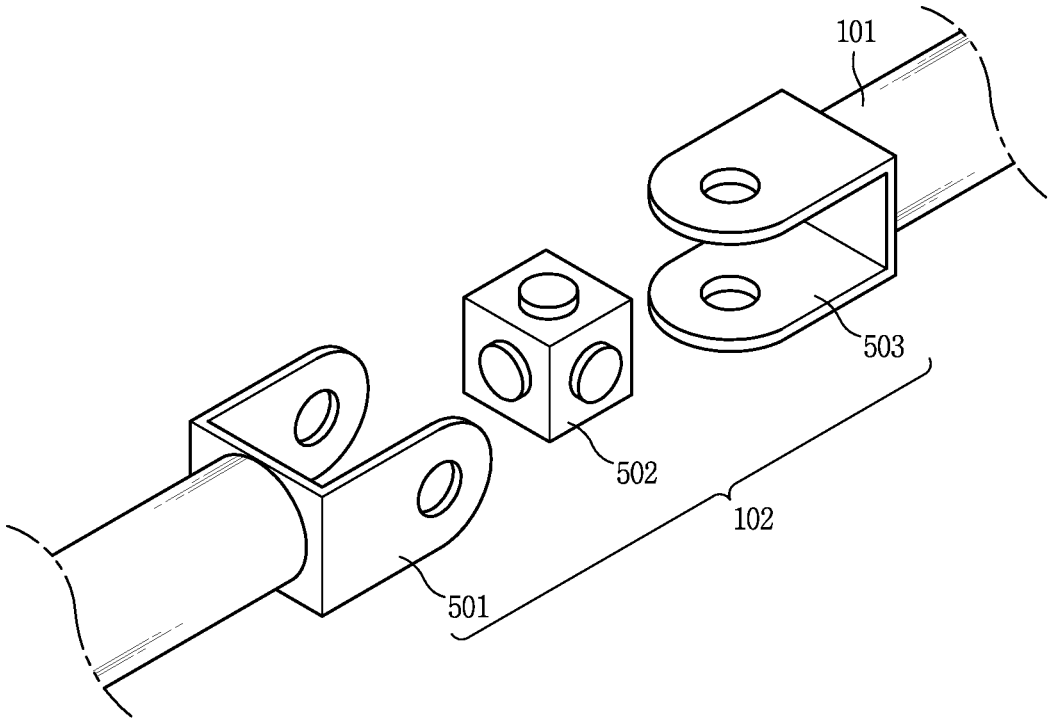
FIGS. 10A and 10B are conceptual views of a cleaner handle according to the present disclosure.

Referring to FIG. 10A, the connecting member 102 may include a first joint member (or first joint head) 501, a spider member 502, and a second joint member or (second joint head) 503. Specifically, the first joint member 501 may be provided on the fixed shaft, and the second joint member 503 may be provided on the rotating shaft.

The first joint member 501 and the second joint member 503 may have a plurality of holes to be connected to the spider member 502. The spider member 502 may also be connected to the first and second joint members 501 and 503 so that the second joint member 503 is rotatable with respect to the first joint member 501. For example, the spider member 502 has a regular hexagonal rigid body, and is provided with protrusions formed on each surface thereof to be inserted through the holes formed through the first and second joint members 501 and 503.

Figure 10B:
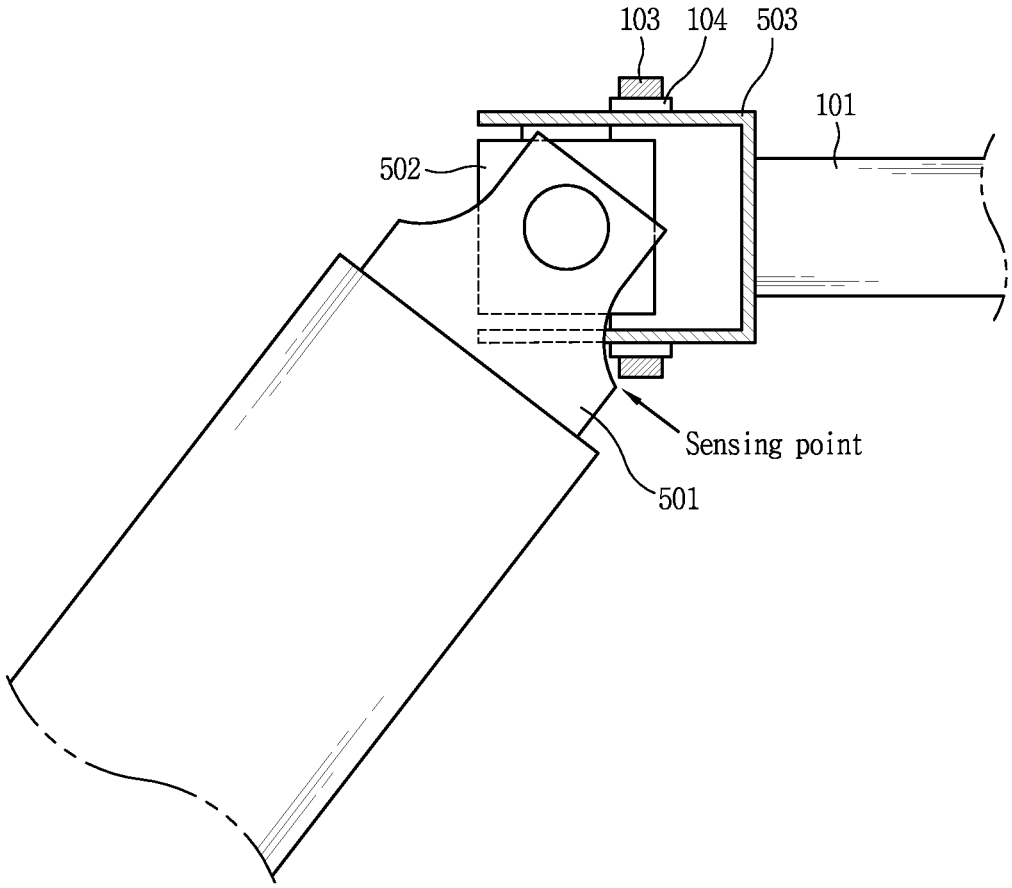

Referring to FIG. 10B, the pressure sensors 103 may be provided on outer surfaces of the first and second joint members 501 and 503, respectively. At this time, the buffer members 104 may be provided between the outer surfaces of the first joint member 501 and the second joint member 503 and the pressure sensors 103, respectively.

More specifically, when the second joint member 503 connected to the grip member 101 is rotated by a predetermined angle, the outer surface of the second joint member 503 may be in contact with the outer surface of the first joint member 501. As described above, the pressure sensor 103 may be provided on any one of contact portions between the first and second joint members.

Figure 11A:
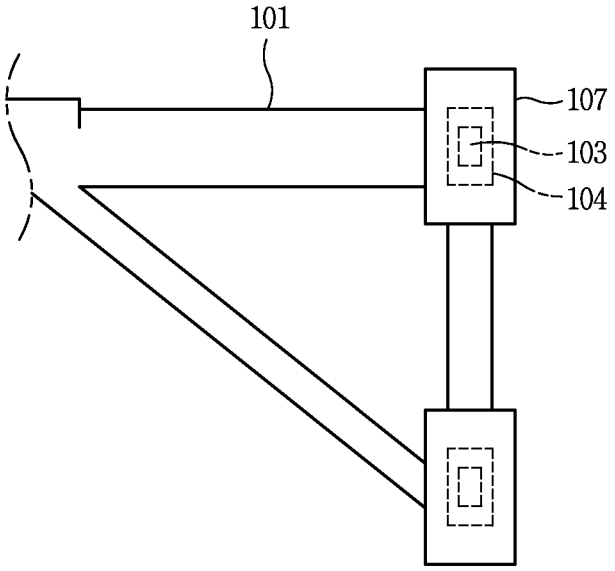
FIGS. 11A to 11D are conceptual views of a cleaner handle according to the present disclosure.

Hereinafter, the cleaner handle 100 according to another embodiment of the present disclosure will be described with reference to FIG. 11A. As illustrated in FIG. 11A, the pressure sensors 103 may be provided on both ends of the grip member 101.

Specifically, the pressure sensors 103 may be provided on both ends of a portion of the grip member 101 which is gripped by the user. Referring to FIG. 11A, the pressure sensors 103 may be provided on both ends of one side of a polygon formed by the grip member 101. On the other hand, the pressure sensors 103 may alternatively be provided irrespective of the shape of the grip member 101.

Preferably, the pressure sensors 103 may be provided at positions spaced apart from a center of rotation of the grip member 101 by a predetermined distance. In one embodiment, a pair of pressure sensors may be provided at positions spaced apart from a center of rotation of the grip member 101 by a predetermined distance in one direction, and another pair of pressure sensors may be provided at positions spaced apart from the center of rotation of the grip member 101 by a predetermined distance in a direction opposite to the one direction.

In another embodiment, the plurality of pressure sensors may be provided at a plurality of points on the outer surface of the grip member 101. In this case, when the grip member 101 rotates, strengths or directions of torque applied to the plurality of points may be different from each other. That is, the pressure sensors 103 may be provided at the plurality of points where the strengths or directions of the torque generated by the rotation of the grip member 101 are different from each other, thereby detecting whether or not the grip member 101 rotates.

Figure 11B:
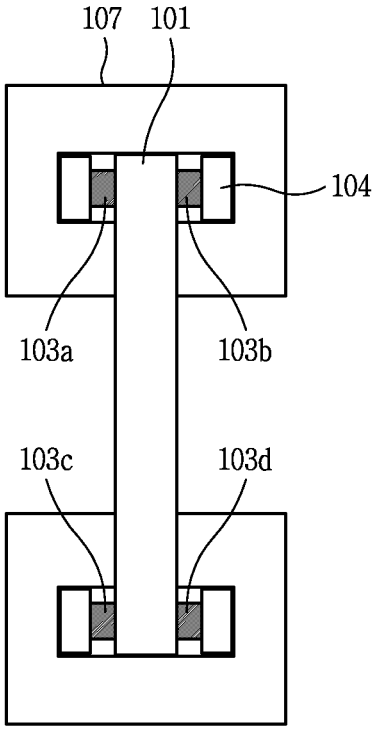

Referring to FIGS. 11A and 11B, a sensor coupling member (or sensor coupling) 107 may couple the grip member 101 and the pressure sensor 103 to each other. For reference, FIG. 11B is a longitudinal sectional view of the grip member 101. Specifically, the sensor coupling member 107 may cover the pressure sensor 103, so that the pressure sensor can be adhered to the grip member 101.

In one embodiment, the sensor coupling member 107 may couple the pressure sensor 103 to the grip member 1010 in a manner that a force applied from the grip member 101 to the pressure sensor 103 changes as at least one of a moving direction and a moving speed of the grip member 101 changes.

Referring to FIG. 11B, the pressure sensor 103 may be provided in a sensor accommodating portion formed by the sensor coupling portion 107 and the grip member 101, to detect strength of pressure applied from the grip member 101, which is changed according to at least one of the moving direction and the moving speed of the grip member 101.

Although not illustrated in FIG. 11B, a recessed sensor accommodating portion (not illustrated) may be formed on one surface of the grip member 101 and the pressure sensor 103 may be provided in the sensor accommodating portion. In this case, the sensor coupling member 107 may be formed to open and close the sensor accommodating portion, and the sensor coupling member 107 may be formed of a plate having a shape corresponding to an entrance of the sensor accommodating portion.

That is, the sensor coupling member 107 according to the present disclosure is not limited to the embodiment illustrated in FIG. 11B, and may be configured in any shape if the pressure sensor 103 or an assembly of the pressure sensor 103 and the buffer member 104 is brought into contact with the outer surface of the grip member 101.

The sensor coupling member 107 may also be configured such that strength of a force received by the pressure sensor in response to the sensor coupling member 107 coupling the pressure sensor 103 to the grip member 101 can be a predetermined strength of force or less.

When an excessive force is applied to the pressure sensor 103 to couple the pressure sensor 103 to the grip member 101, there is a problem that the output of the pressure sensor 103 is difficult to be reliable. Therefore, the sensor coupling member 107 may cover the pressure sensor 103 and simultaneously apply a force of appropriate strength to the assembly of the pressure sensor 103 and the buffer member 104, such that a portion of the pressure sensor 103 which detects pressure can be brought into contact with the outer surface of the grip member 101.

In addition, the user may preferably measure the strength of the force applied to the pressure sensor 103 in response to the sensor coupling member 107 coupling the pressure sensor 103 to the grip member 101, and store information related to the measured value in a memory. The controller 180 may correct the output of the pressure sensor 103 using the information related to the measured value stored by the user.

The buffer member 104 may be provided between the pressure sensor 103 and the sensor coupling member 107. At this time, the buffer member 104 may be formed of an elastic material having an outer shape deformable by an external force. For example, the buffer member 104 may be a spring, sponge, or rubber. That is, the buffer member 104 may be coupled to another portion of the pressure sensor 103 that faces the portion of the pressure sensor 103 detecting pressure.

According to the embodiment illustrated in FIG. 11B, four pressure sensors 103*a*, 103*b*, 103*c*, and 103*d* are provided on the outer surface of the grip member 101. Specifically, the pressure sensor 103 may include first and second pressure sensors 103*a* and 103*b* provided on one end of the grip member 101, and third and fourth pressure sensors 103*a* and 103*b* provided on another end of the grip member 101.

Referring to FIG. 11B, pressure-detecting portions of the first and second pressure sensors 103*a* and 103*b* may face each other. That is, the first and second pressure sensors 103*a* and 103*b* may be provided on opposite surfaces of the grip member 101, respectively, and the pressure-detecting portion of the first pressure sensor 103*a* and the pressure-detecting portion of the second pressure sensor 103*b* may be brought into contact with the grip member 101, respectively.

Likewise, pressure-detecting portions of the third and fourth pressure sensors 103*c* and 103*d* may face each other. That is, the third and fourth pressure sensors 103*c* and 103*d* may be provided on opposite surfaces of the grip member 101, respectively, and the pressure-detecting portion of the third pressure sensor 103*c* and the pressure-detecting portion of the fourth pressure sensor 103*d* may be brought into contact with the grip member 101, respectively.

The controller 180 may compare the outputs of the first to fourth pressure sensors 103*a*, 103*b*, 103*c*, and 103*d* and detect information related to at least one of the rotating direction and the moving direction of the grip member 101 based on the comparison result.

Figure 11C:
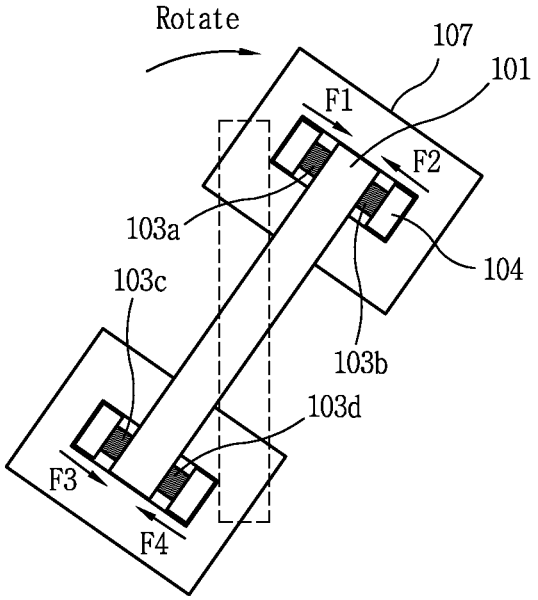

Hereinafter, description will be given of a method of detecting the rotating direction of the grip member 101 by comparing the output values of the plurality of pressure sensors 103 when the user rotates the grip member 101 in a clockwise direction, with reference to FIG. 11C. As illustrated in FIG. 11C, the first to fourth pressure sensors 103*a*, 103*b*, 103*c* and 103*d* may detect forces F1, F2, F3 and F4 applied between them and the outer surface of the grip member 101.

The forces applied between the plurality of pressure sensors and the outer surface of the grip member 101 may change when the grip member 101 rotates. For example, as illustrated in FIG. 11C, when the grip member 101 rotates in the clockwise direction, the forces F1 and F4 applied between the first and fourth pressure sensors 103*a* and 103*d* and the grip member 101 may be reduced and the forces F2 and F3 applied between the second and third pressure sensors 103*b* and 103*c* and the grip member 101 may increase.

In one embodiment, the controller 180 may compare the output values of the first to fourth pressure sensors with a plurality of preset reference output values, and detect the rotating direction of the grip member 101 based on the comparison result.

Specifically, the controller 180 may set reference information corresponding to each of the plurality of pressure sensors. The reference information may include an upper limit value and a lower limit value associated with the output of the pressure sensor. The controller 180 may set the upper limit value and the lower limit value corresponding to one of the plurality of pressure sensors based on a distance between an installed point of the one pressure sensor and the center of rotation of the grip member 101.

The upper limit value may increase as a distance between an installed point of a pressure sensor and a center of rotation of an object increases, in consideration of the fact that a torque generated by the rotation increases as the installed point is getting away from the center of rotation of the object. When the output of one pressure sensor is reduced below the lower limit value corresponding to the one pressure sensor, the controller 180 may determine that a portion of the grip member 101 with the one pressure sensor provided thereon is moving in a direction that the pressure-detecting portion of the one pressure sensor faces.

On the other hand, when the output of one pressure sensor is increased to more than the upper limit value, which corresponds to the one pressure sensor, the controller 180 may determine that a portion of the grip member 101 with the one pressure sensor provided thereon is moving in an opposite direction to the direction that the pressure-detecting portion of the one pressure sensor faces.

In this way, the controller 180 can compare the output values of some of the plurality of pressure sensors with the upper limit values or the lower limit values corresponding to those pressure sensors, so as to detect moving directions of contact points of the grip member 101 with those pressure sensors, respectively. In addition, the controller 180 may detect the moving or rotating direction of the grip member 101 based on the detected direction.

For example, when the output of the first pressure sensor 103*a* is reduced less than the lower limit value set in correspondence with the first pressure sensor 103*a* and the output of the third pressure sensor 103*c* is increased more than the upper limit value set in correspondence with the third pressure sensor 103*c*, the controller 180 may determine that the grip member 101 rotates clockwise with reference to the forward direction of the main body 10.

In another example, when the output of the first pressure sensor 103*a* is reduced less than the lower limit value set in correspondence with the first pressure sensor 103*a* and the output of the second pressure sensor 103*b* increases more than the lower limit value set in correspondence with the second pressure sensor 103*b*, the controller 180 may determine that the grip member 101 rotates clockwise with reference to the forward direction of the main body 10.

In another example, when the output of the first pressure sensor 103*a* is reduced less than the lower limit value set in correspondence with the first pressure sensor 103*a* and the output of the fourth pressure sensor 103*d* is reduced below the lower limit value set in correspondence with the fourth pressure sensor 103*d*, the controller 180 may determine that the grip member 101 rotates clockwise with reference to the forward direction of the main body 10. The controller 180 may also detect the rotating direction of the grip member 101 by comparing output values of two pressure sensors provided on both surfaces of one of both ends of the grip member 101.

In another embodiment, the controller 180 may determine whether the outputs of the first to fourth pressure sensors is increased or decreased, and detect the rotating direction of the grip member 101 based on the determination result. For example, the controller 180 may periodically calculate an increase rate of the output of one of the first to fourth pressure sensors. When the calculated increase rate exceeds a preset reference increase rate, the controller 180 may determine that the portion of the grip member 101 with the one pressure sensor provided thereon moves opposite to the direction that the pressure-detecting portion of the one pressure sensor faces.

Hereinafter, description will be given of a method of detecting the moving direction of the grip member 101 by comparing the output values of the plurality of pressure sensors 103 when the user moves the grip member 101 to the right, with reference to FIG. 11D. When the grip member 101 moves, forces applied between the plurality of pressure sensors and the outer surface of the grip member 101 may be changed. For example, as illustrated in FIG. 11D, when the grip member 101 moves in the right direction, the forces F1 and F3 applied between the first and third pressure sensors 103*a* and 103*c* and the grip member 101 may be reduced and the forces F2 and F4 applied between the second and fourth pressure sensors 103*b* and 103*d* and the grip member 101 may be increased.

In one embodiment, when the outputs of at least two of the plurality of pressure sensors provided on one of both surfaces of the grip member 101 are increased, the controller 180 may determine that the grip member 101 moves in a direction that the one surface faces. Preferably, when the output of each of the plurality of pressure sensors provided on one of both surfaces of the grip member 101 increases, the controller 180 may determine that the grip member 101 moves in a direction that the one surface faces.

In another embodiment, when the outputs of at least two of the plurality of pressure sensors provided on one of both surfaces of the grip member 101 exceeds a preset reference output value, the controller 180 may determine that the grip member 101 moves in a direction that the one surface faces.

Figure 11D:
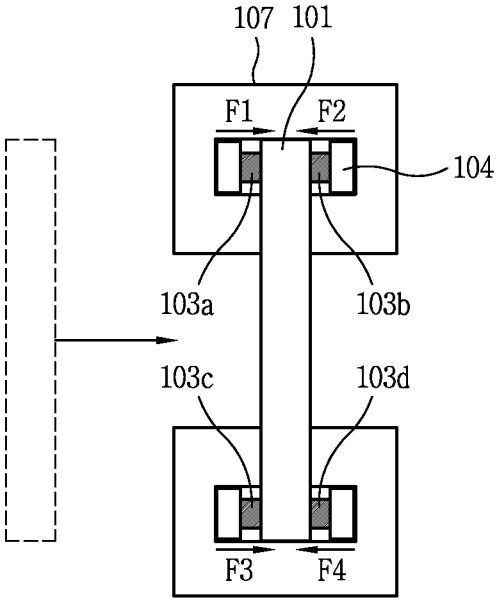

As illustrated in FIGS. 11C and 11D, the controller 180 may determine whether the grip member 101 rotates or moves in one direction by comparing the outputs of the plurality of pressure sensors. In addition, the controller 180 may control the driving unit 150 to provide an auxiliary driving force in the determined direction. That is, when it is determined that the user moves the grip member 101 to the right, the controller 180 may control the driving unit 150 to provide the auxiliary driving force in the right direction.

The controller 180 may also control the driving unit 150 to rotate the main body 10 counterclockwise when it is determined that the user rotates the grip member 101 in the clockwise direction. Specifically, when the traveling direction of the cleaner or the direction that the user wants to move the cleaner is determined, the controller 180 may control the driving unit 150 to generate the driving force in the determined traveling direction or increase an existing driving force.

According to a vacuum cleaner and a control method thereof according to the present disclosure, user's intention to move the cleaner can be recognized so that an auxiliary driving force can be provided in a direction intended by the user, thereby improving user's convenience. Further, the user of the vacuum cleaner according to the present disclosure can easily move a cleaner body in a desired direction even with a small force. In addition, according to these aspects, a load applied on the user's finger or wrist can be minimized, thereby improving the user's convenience.

Figure 12:
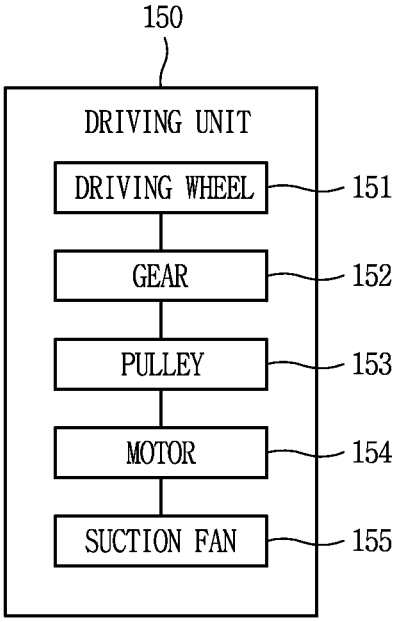
FIG. 12 is a block diagram illustrating components of a driving unit according to the present disclosure.

FIG. 12 illustrates components of the driving unit 150. The driving unit 150 may include at least one of a driving wheel 151, a gear portion 152, a pulley 153, a motor 154 and a suction fan 155.

The gear portion 152 is provided to transmit power and has a preset reduction gear ratio. That is, the gear portion 152 may transmit a rotational force applied thereto to the main body 10 or a nozzle portion 31 of the suction nozzle, based on the set reduction gear ratio. For example, the gear portion 152 may be formed in a manner that a plurality of gear members is engaged with each other.

In another example, the gear portion 152 may be formed in a manner that two gear members are connected to each other through a belt. In another example, the gear portion 152 may be formed in a manner that a plurality of gear members is uniaxially provided.

That is, the gear portion 152 has a reduction gear ratio determined by mechanical characteristics thereof, and changes and outputs the number of turns (rotations, revolutions) input based on the reduction gear ratio. Since functions and detailed components of the gear itself are well known, further explanation will be omitted.

Figure 13:
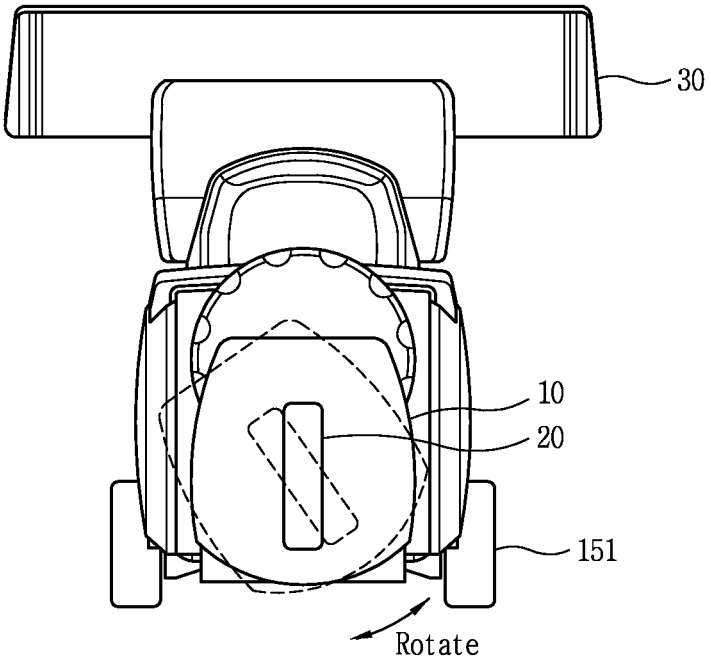
FIG. 13 is a conceptual view illustrating that a handle rotates with respect to a main body in a direction that the ground faces according to the present disclosure.

Referring to FIG. 13, the gear portion 152 may connect the main body 10 and the handle 20 so that the handle 20 is rotatable with respect to the main body 10 in a direction which the ground faces. Specifically, the gear portion 152 may be provided on a portion of the main body 10, and a rotatable end of the gear portion 152 may be coupled to one end of the handle 20.

For example, when the gear portion 152 is installed inside the main body 10, a hole through which one end of the handle is inserted may be provided on the outer surface of the main body. One end of the handle 20 and the gear portion 152 may be coupled to each other through the hole. In order for the handle 20 to be rotatably connected to the gear portion 152, the hole is preferably formed in a circular shape. In addition, the handle 20 preferably has a circular cross section.

Figure 14A:
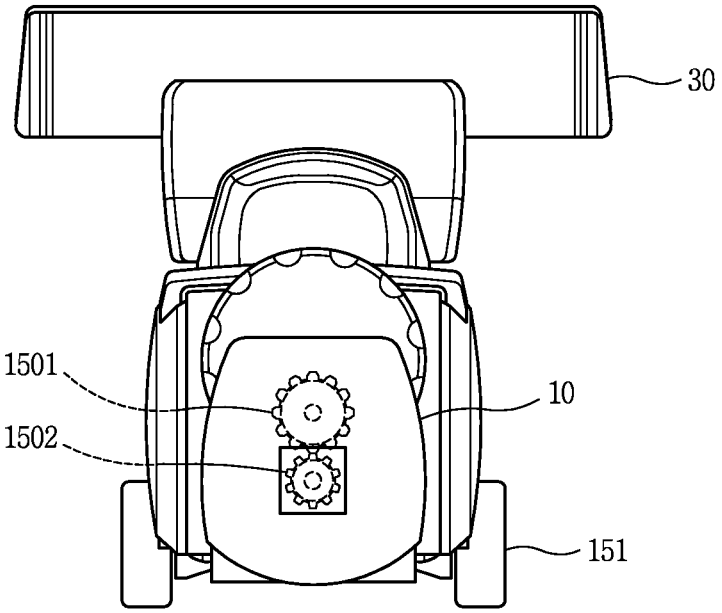
FIGS. 14A to 14C are conceptual views of a cleaner according to the present disclosure.
Figure 14B:
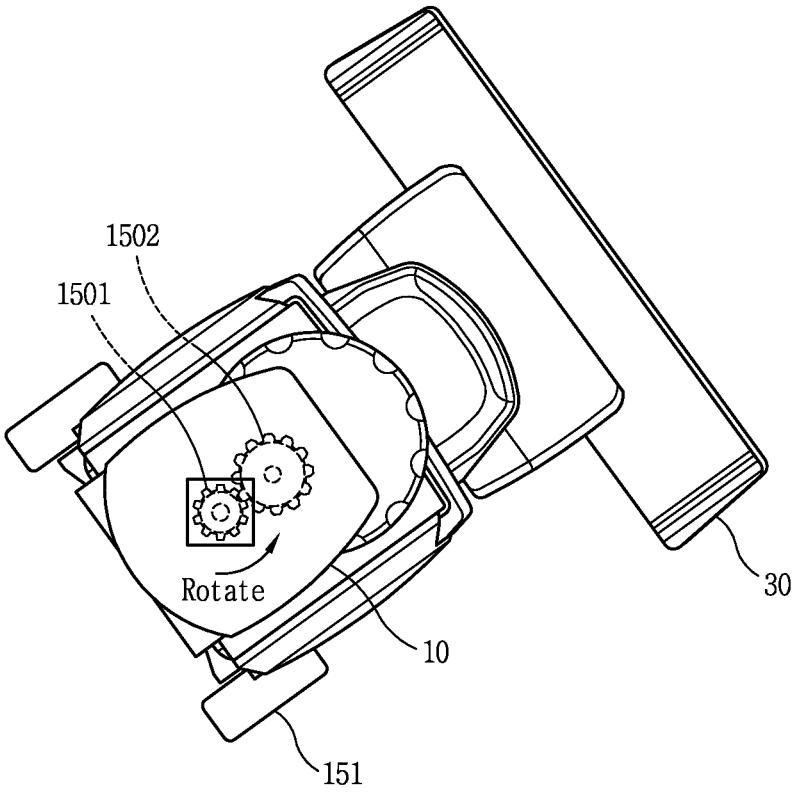

Hereinafter, one embodiment of a cleaner according to the present disclosure will be described with reference to FIGS. 14A and 14B. Referring to FIG. 14A, the gear portion 152 may include a first gear member 1501 connected to the handle 20 and a second gear member 1502 connected to the main body 10.

As described above, the handle 20 may be provided on the top of the main body 10 to be coupled to a part of the gear portion 152 so as to be rotatable with respect to the main body in a direction that the ground faces. At this time, the part of the gear portion 152 to which the handle 20 is coupled may correspond to the first gear portion 1501.

When the handle 20 is rotated by the user, the gear portion 152 may receive a rotational force from the handle 20 and transmit the rotational force applied from the handle 20 to the main body 10. That is, the gear portion 152 may transmit an external force applied by the user to the main body 10 through the handle 20.

Specifically, the second gear member 502 may be fixedly coupled to a portion of the main body 10. In other words, the second gear member 502 may not rotate with respect to the main body 10. Further, the first gear member 1501 may be fixedly coupled to a part of the handle 20. Particularly, the assembly of the first gear member 1501 and the handle 20 may be rotatable centering on a rotating shaft formed on one point of the main body.

In one embodiment, the first gear member 1501 and the second gear member 1502 may be formed to be engaged with each other. Referring to FIG. 14B, the first gear member 1501 may be rotatable with respect to the main body 10 and the second gear member 502 may be fixed with respect to the main body. Therefore, when the user rotates the handle 20, the assembly of the second gear member 1502 and the main body 10 rotates with respect to the ground centering on the rotating shaft of the first gear member 1501 in an opposite direction to the direction that the user rotates the handle 20.

Since a gear ratio is formed by the first gear member 1501 and the second gear member 1502, an angle by which the user rotates the handle 20 and an angle by which the main body 10 rotates are different from each other. On the other hand, the number of teeth of the first gear member 1501 may be smaller than the number of teeth of the second gear member 1502. In this case, a larger rotational force than the rotational force generated by the user can be transmitted to the main body 10. This may facilitate the user to move or rotate the heavy main body 10.

Figure 14C:
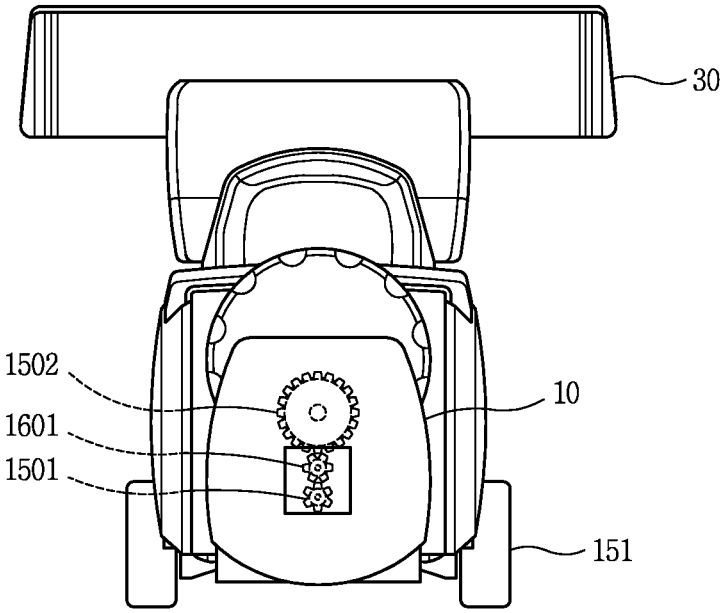

Referring to FIG. 14C, the gear portion 152 may further include a third gear member 1503 engaged with the first gear member 1501 and the second gear member 1502, respectively. Specifically, the third gear member 1503 may be rotatable centering on a rotating shaft which is formed at a different point from that of the center of rotation of the first gear member 1501.

In other words, as illustrated in FIG. 14A, when two gear members are engaged with each other, the direction in which the user rotates the handle and the direction in which the main body rotates are opposite to each other. Accordingly, a separate third gear member can be inserted between the second gear member fixed to the main body and the first gear member rotatably coupled to the handle, such that the direction in which the user rotates the handle and the direction in which the main body rotates can be made the same as each other.

Figure 15A:
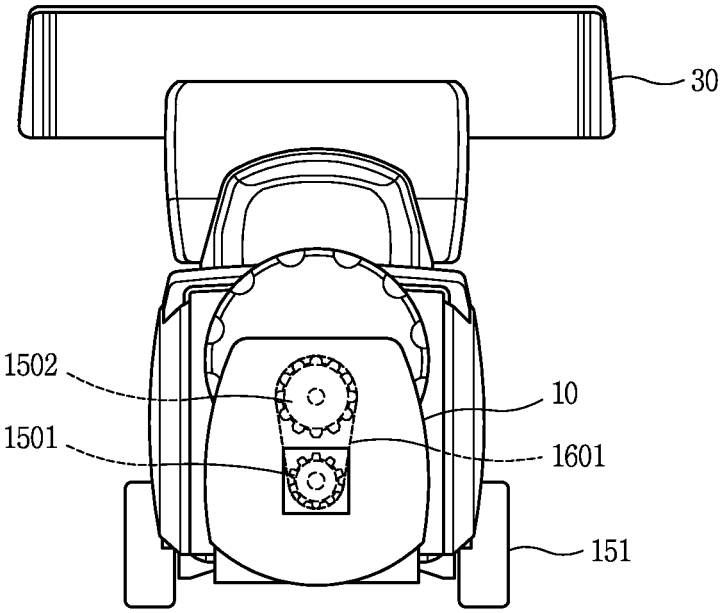
FIGS. 15A and 15B are conceptual views of a cleaner according to the present disclosure.
Figure 15B:
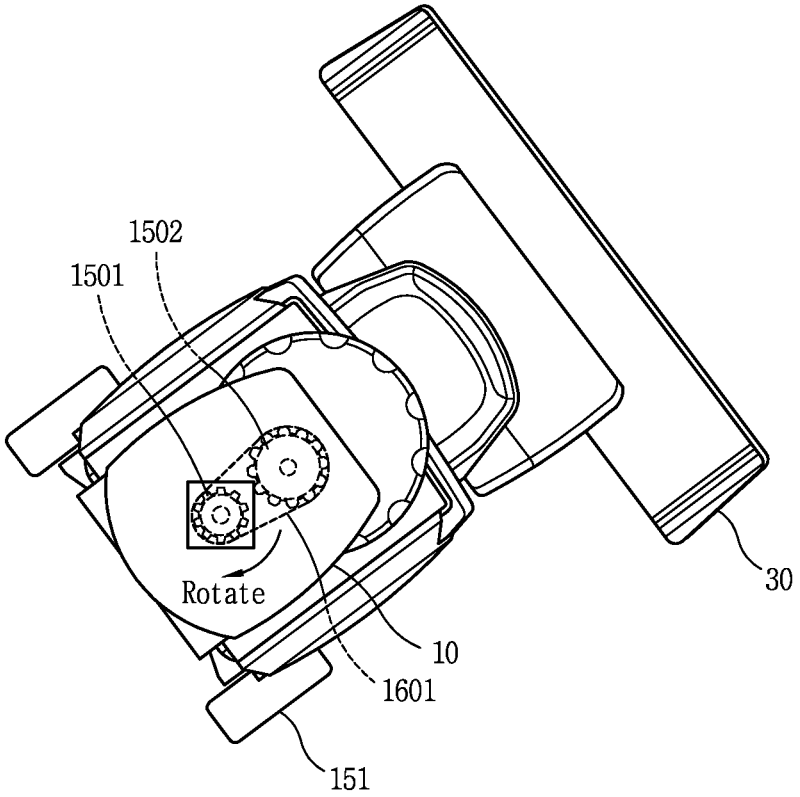

Referring to FIG. 15A, the gear portion 152 may further include a belt member 1601 for transferring power generated in the second gear member 1502 to the first gear member 1501. Referring to FIG. 15B, when two gear members are connected to each other through the belt member 1601, the direction in which the user rotates the handle and the direction in which the main body rotates can coincide with each other Although not illustrated in FIGS. 15A and 15B, the first gear member and the second gear member may be uniaxially connected to each other. That is, a power input portion and a power output portion of the gear portion 152 may be uniaxially formed. At this time, the gear portion 152 may be formed such that the uniaxially-connected first and second gear members can rotate in the same direction.

Figure 16A:
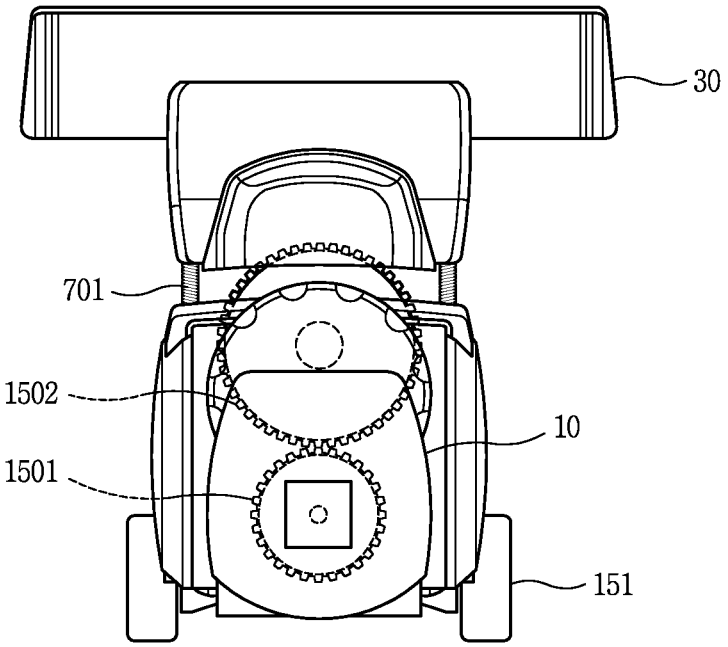
FIGS. 16A to 16C are conceptual views of a cleaner according to the present disclosure.

Referring to FIG. 16A, the nozzle portion 31 may be spaced apart from the main body 10. In addition, the nozzle portion 31 and the main body 10 may be connected to each other through a connecting member 701. The first gear member 1501 may rotate centering on a rotating shaft formed at one point of the main body 10 and the second gear member 1502 may rotate centering on a rotating shaft formed at another point of the main body 10. The first gear member 1501 may be fixedly coupled to a part of the handle and the second gear member 1502 may be formed to be fixedly coupled to a portion of the nozzle portion 314.

Figure 16B:
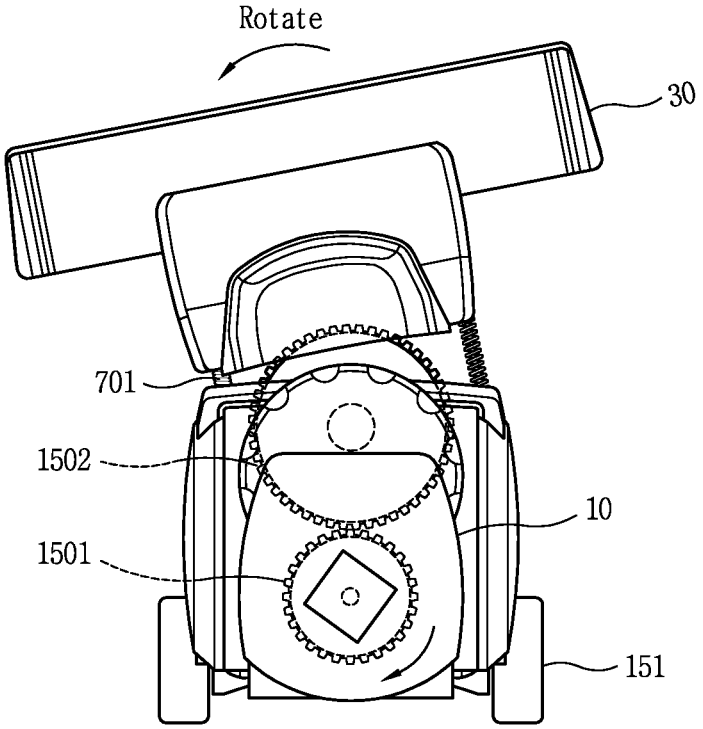
Figure 16C:
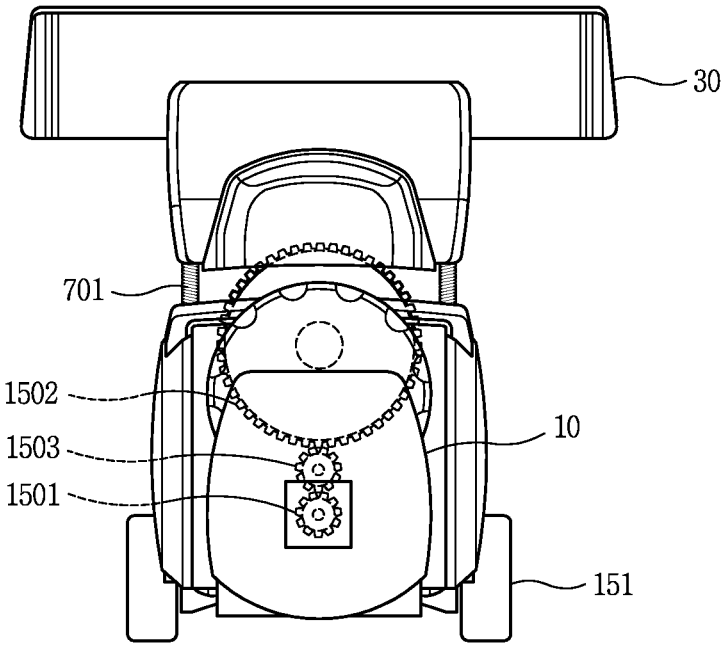

Referring to FIG. 16B, when the user rotates the handle 20, the nozzle portion 31 may rotate in a direction opposite to a direction in which the user rotates the handle 20. Referring to FIG. 16C, the third gear member 1503 may be provided between the first gear member 1501 and the second gear member 1502. When the first gear member and the third gear member are engaged with each other and the second gear member and the third gear member are engaged with each other, the rotating direction of the handle 20 and the rotating direction of the nozzle portion 31 may be made the same as each other. As such, by adjusting the number of gears included in the gear portion and engaged with each other and the gear ratio between the engaged gears, the rotating direction of the nozzle can change according to the rotating direction of the handle or the rotated angle of the nozzle can change according to the rotated angle of the handle.

Although not illustrated, the first gear member 1501 may rotate centering on the rotating shaft formed at one point of the main body 10 and the second gear member 1502 may be provided at an opposite side to a direction in which the nozzle portion 31 is located, based on the rotating shaft of the first gear member 1501. At this time, the second gear member 1502 may be fixedly coupled to a part of the main body 10.

According to the vacuum cleaner of the present disclosure, the user can move or rotate the main body merely by applying a relatively weak force, thereby enhancing user convenience. In addition, the user of the vacuum cleaner according to the present disclosure can easily move the cleaner body in a desired direction even with a weak force, and thus a load on the user's finger or wrist can be minimized. An aspect of the present disclosure is to provide a vacuum cleaner, which performs a travel algorithm that reflects user's intention, to facilitate movement or travel of an upright type vacuum cleaner according to the user's intention, and a handle of the cleaner.

Another aspect of the present disclosure is to provide a vacuum cleaner, which actively reflects user's intention by providing separate physical force that assists movement of the cleaner in a user-intended direction, and a handle of the cleaner. Another aspect of the present disclosure is to provide an upright type vacuum cleaner that follows a user, and a handle of the cleaner.

Another aspect of the present disclosure is to provide a vacuum cleaner capable of reducing magnitude of force required to move or rotate a main body. Another aspect of the present disclosure is to provide a vacuum cleaner which can be easily moved or rotated by a user.

To achieve these aspects or other aspects of the present disclosure, there is provided a cleaner, including a cleaner a main body, a grip unit provided on the main body to be gripped by a user, a pressure sensor unit provided in the grip unit to detect pressure applied by the user to a part of an outer surface of the grip unit, a driving unit provided at a lower portion of the main body to move the main body, and a controller to control the driving unit based on the detected pressure.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present disclosure.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cleaner, comprising:

a main body;

a handle provided on the main body to be gripped by a user;

a pressure sensor provided on the handle to detect pressure applied by the user to the handle;

a motor to selectively apply a driving force;

a driving wheel provided at a lower portion of the main body to move the main body based on receiving the driving force from the motor;

an angle sensor provided between the main body and the handle to detect information related to a rotation of the handle relative to the main body; and a controller to manage the motor based on the detected pressure applied by the user to the handle.

2. The cleaner of claim 1, wherein the controller determines that the user has gripped the handle when the detected pressure is equal to or exceeds a reference pressure value.

3. The cleaner of claim 2, wherein the controller determines that the user has gripped the handle when the detected pressure is within a reference pressure range.

4. The cleaner of claim 1, wherein the pressure sensor includes a plurality of pressure sensors that detect levels of pressure applied to a plurality of different points on an outer surface of the handle, respectively.

5. The cleaner of claim 4, wherein the controller:

compares a first pressure detected by a first one of the plurality of pressure sensors with a second pressure detected by a second one of the plurality of pressure sensors that is provided behind the first pressure sensor based on a traveling direction of the cleaner, and determines whether the cleaner is moving forward or backward based on comparing the first pressure and the second pressure.

6. The cleaner of claim 5, wherein the controller determines that the cleaner is moving forward when the first pressure is smaller than the second pressure.

7. The cleaner of claim 5, wherein the controller determines that the cleaner is moving backward when the second pressure is smaller than the first pressure.

8. The cleaner of claim 5, wherein the controller manages the motor to generate or modify the driving force to cause the driving wheel to move the body toward the determined traveling direction or to assist the assist the user to move the cleaner based on the traveling direction of the cleaner.

9. The cleaner of claim 4, wherein the controller compares respective pressures detected by two pressure sensors, of the plurality of pressure sensors, that are arranged vertically on a left-side surface or a right-side surface of the handle based on a traveling direction of the cleaner, and determines whether the cleaner rotates clockwise or counterclockwise based on comparing the respective pressures.

10. The cleaner of claim 9, wherein the two pressure sensors are provided on the left-side surface, and the controller determines that the cleaner is rotating counterclockwise relative to the travelling direction when the pressure detected by the lower one of the two pressure sensors is greater than the pressure detected the higher one of the two pressure sensors.

11. The cleaner of claim 9, wherein the two pressure sensors are provided on the right-side surface, and the controller determines that the cleaner is rotating clockwise relative to the traveling direction when the pressure detected by the lower one of the two pressure sensors is greater than the pressure detected by the higher one of the two pressure sensors.

12. The cleaner of claim 1, wherein the controller further detects a rotating direction of the cleaner based on comparing the information detected by the angle sensor and an output of the pressure sensor.

13. The cleaner of claim 1, wherein the pressure sensor provided on the handle is a first pressure sensor, and the angle sensor includes a second pressure sensor provided at a joint between the handle and the main body.

14. The cleaner of claim 13, wherein the joint connects an end of the handle with an end of the main body, and the second pressure sensor detects a pressure associated with a contact between the end of the handle and the end of the main body.

15. The cleaner of claim 1, further comprising an auxiliary driving mechanism provided between the main body and the driving wheel to provide an auxiliary driving force in a rotating direction of the main body when the main body rotates in a prescribed direction.

16. The cleaner of claim 15, wherein the auxiliary driving mechanism includes at least one of a timing belt coupled to the motor or another motor, or a speed reducer coupled to the motor or another motor.

17. The cleaner of claim 1, wherein the controller manages the motor to cause the driving wheel to move the main body to reduce the pressure detected by the pressure sensor.

18. The cleaner of claim 1, wherein the controller manages the motor to generate or modify the driving force such that the driving wheel moves the main body toward a determined traveling direction or to assist the user in moving the cleaner based on the traveling direction of the cleaner.

19. The cleaner of claim 1, wherein the controller:

monitors respective pressures detected by the pressure sensor at two or more different times, and controls the motor to stop the driving wheel or to change a rotating direction of the driving wheel when the pressure sensor detects an increase in the pressure.

20. The cleaner of claim 1, wherein the angle sensor detects at least one of a rotation angle between the handle and the main body, a rotating speed of the handle with respect to the main body, or an angle that the handle is rotated relative to a reference axis.

* * * * *